US012140065B2

(12) United States Patent
Bostick et al.

(10) Patent No.: US 12,140,065 B2
(45) **Date of Patent: *Nov. 12, 2024**

(54) SYSTEM AND METHOD FOR TREATING GAS TURBINE EXHAUST GAS

(71) Applicant: Nooter/Eriksen, Inc., Fenton, MO (US)

(72) Inventors: Glen L. Bostick, Columbia, IL (US); Shaun P. Hennessey, St. Charles, MO (US); Nathan Ross, Ballwin, MO (US)

(73) Assignee: Nooter/Eriksen, Inc., Fenton, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/329,255

(22) Filed: Jun. 5, 2023

(65) Prior Publication Data

US 2023/0332529 A1 Oct. 19, 2023

Related U.S. Application Data

(63) Continuation-in-part of application No. 17/487,887, filed on Sep. 28, 2021, now Pat. No. 11,668,219.

(60) Provisional application No. 63/084,290, filed on Sep. 28, 2020.

(51) Int. Cl.

| | |
|---|---|
| ***F01N 5/02*** | (2006.01) |
| ***F01N 3/02*** | (2006.01) |
| ***F01N 3/20*** | (2006.01) |
| ***F01N 3/28*** | (2006.01) |
| ***F01N 13/00*** | (2010.01) |

(52) U.S. Cl.

CPC ..... *F01N 5/02* (2013.01); *F01N 3/0205* (2013.01); *F01N 3/20* (2013.01); *F01N 13/002* (2013.01); *F01N 3/2046* (2013.01); *F01N 3/2073* (2013.01); *F01N 3/2889* (2013.01); *F01N 2240/02* (2013.01); *F01N 2590/00* (2013.01); *F01N 2610/02* (2013.01)

(58) Field of Classification Search

CPC combination set(s) only.
See application file for complete search history.

(56) References Cited

U.S. PATENT DOCUMENTS

| | | | |
|---|---|---|---|
| 5,352,272 | A | 10/1994 | Moll et al. |
| 8,046,989 | B2 | 11/2011 | VanderGriend et al. |
| 8,062,617 | B2 | 11/2011 | Stakhev et al. |
| 8,166,752 | B2 | 5/2012 | Garcia et al. |
| 8,479,501 | B2 | 7/2013 | McCarthy, Jr. |
| 8,534,039 | B1 | 9/2013 | Pierson et al. |
| 8,820,078 | B1 | 9/2014 | Duffy |

(Continued)

*Primary Examiner* — Binh Q Tran
(74) *Attorney, Agent, or Firm* — Sandberg Phoenix & von Gontard, P.C.

(57) ABSTRACT

A system and method for treating turbine exhaust gas for improved operational flexibility includes a turbine exhaust gas discharge structure, a catalytic turbine exhaust gas treatment device positioned at least partially within the turbine exhaust gas discharge structure, a pump, and at least two heat exchangers. A first heat exchanger is positioned at least partially within the turbine exhaust gas discharge structure to remove heat from turbine exhaust gas by transferring heat to a working fluid. A second heat exchanger removes heat from the working fluid gained at the first heat exchanger. The pump drives the working fluid between the first and second heat exchanger. In a further embodiment, the catalytic turbine exhaust gas treatment device is replaced by a heat recovery steam generator.

27 Claims, 13 Drawing Sheets

(56) References Cited

U.S. PATENT DOCUMENTS

| | | | | |
|---|---|---|---|---|
| 9,109,532 | B2 | 8/2015 | Geskes et al. | |
| 9,435,228 | B2 | 9/2016 | Sieben et al. | |
| 9,512,759 | B2 | 12/2016 | Muthaiah et al. | |
| 9,915,200 | B2 | 3/2018 | Minto et al. | |
| 10,107,495 | B2 | 10/2018 | Minto | |
| 10,982,570 | B2 * | 4/2021 | Conlon | F01K 11/02 |
| 11,668,219 | B2 * | 6/2023 | Bostick | F01N 3/2073 60/320 |
| 2005/0000473 | A1 | 1/2005 | Ap | |
| 2006/0213183 | A1 | 9/2006 | Althaus | |
| 2008/0302519 | A1 * | 12/2008 | Franklin | F28C 1/14 165/164 |
| 2011/0083426 | A1 * | 4/2011 | Ikemoto | F01P 7/165 60/297 |
| 2011/0131962 | A1 | 6/2011 | Toi et al. | |
| 2012/0036850 | A1 | 2/2012 | Ernst et al. | |
| 2014/0102073 | A1 | 4/2014 | Pang et al. | |
| 2014/0352279 | A1 * | 12/2014 | Gonze | F01N 3/2046 60/274 |
| 2015/0013328 | A1 | 1/2015 | Carstensen et al. | |
| 2015/0376801 | A1 | 12/2015 | Bairamijamal | |
| 2017/0159542 | A1 | 6/2017 | Bilancia et al. | |
| 2017/0350320 | A1 | 12/2017 | Kippel et al. | |
| 2017/0356386 | A1 | 12/2017 | Hombsch et al. | |
| 2018/0238220 | A1 | 8/2018 | Itou et al. | |
| 2019/0264580 | A1 | 8/2019 | Zuschlag | |
| 2019/0276757 | A1 | 9/2019 | Liss et al. | |
| 2019/0301749 | A1 * | 10/2019 | Houssainy | F01K 23/06 |
| 2021/0003103 | A1 * | 1/2021 | Singh | F02M 26/36 |
| 2022/0049631 | A1 | 2/2022 | Deng | |
| 2022/0099012 | A1 | 3/2022 | Bostick et al. | |

* cited by examiner

SYSTEM AND METHOD FOR TREATING GAS TURBINE EXHAUST GAS

CROSS-REFERENCE TO RELATED APPLICATIONS

This application is a Continuation-In-Part of U.S. patent application Ser. No. 17/487,887, filed Sep. 28, 2021, which claims the benefit of U.S. Provisional Patent Application Ser. No. 63/084,290, filed Sep. 28, 2020, both of which are hereby incorporated herein by reference in their entireties.

STATEMENT REGARDING FEDERALLY SPONSORED RESEARCH OR DEVELOPMENT

Not Applicable.

BACKGROUND OF THE DISCLOSURE

Exhaust gasses from a variety of processes and/or combustion of a variety of fuels typically include one or more harmful substances such as carbon monoxide and/or nitrogen oxide. For example, combustion of natural gas or other fossil fuels in power plants generates a hot exhaust gas stream including carbon monoxide, nitrogen oxides, and/or other exhaust gases. Chemical production, hydrocarbon cracking, steel production, and other processes similarly generate a hot exhaust gas stream including harmful substances. Typically, an exhaust gas stream is treated with one or more catalysts (e.g., in a catalyst bed) to mitigate carbon monoxide, nitrogen dioxide, and/or other substances. For example, catalysts can be used to convert nitrogen dioxide and/or carbon monoxide to one or more of water, diatomic nitrogen, carbon dioxide, and/or other less harmful compounds. To treat nitrogen oxides using a catalyst, typically a reactant is used such as anhydrous ammonia or an aqueous solution of ammonia that is introduced upstream of a selective catalytic reaction (SCR) catalyst.

Each catalyst and/or reactant has an operating temperature range that optimizes the desired reaction to mitigate components of the exhaust gas. Additionally, the catalyst or reactant itself and/or the housing (e.g., SCR) or material containing the catalyst and/or reactant can be damaged if the temperature of the exhaust gas exceeds the mechanical/chemical design limits for the catalyst or housing. Therefore, it is sometimes advantageous to controllably reduce the temperature of the exhaust gas prior to passing the exhaust gas into the catalyst materials such that the exhaust gas is within a temperature range for optimum treatment of certain components within the exhaust gas.

Many existing exhaust gas cooling systems and exhaust treatment systems suffer from inferior performance, limited operational flexibility, lifespan, efficiency and the like due to the limitations of cooling systems and the requirements of the exhaust treatment systems described above.

Power plants are very complex, incorporating many systems to ensure efficient, productive performance. Boilers and/or Heat Recovery Steam Generators (HRSGs) form the heart of the power plant and are engineered for a specified range of intended operational conditions. This range can be very broad but once defined, operation outside of these conditions can cause operational issues or even safety issues.

Many fossil fuel power plants have been forced to reconsider their operational profile as they contend with the effects of increased renewable energy. In addition to impacts from renewable generation, the natural fluctuations in power demand between the daytime and nighttime vary greatly with a significantly reduced power demand occurring in the evening/overnight hours. Power plants want to reduce output during these low demand conditions so to save significant operating costs.

However, for typical combined cycle power plants (i.e., a power cycle using a gas turbine (GT), which discharges into a Heat Recovery Steam Generator (HRSG)), as power demand decreases the GT power output is reduced. The reduction in gas turbine output typically results in both a reduction in exhaust flow into the HRSG and an increase in exhaust temperature into the HRSG. Both of these effects (lower exhaust flow and hotter gas temperature) result in the boiler performing off design, meaning at a lower efficiency than intended. As power load is further reduced, there is a point at which further reduction cannot be performed without operating the equipment/facility in an unsafe manner. Further complicating the operation of the system is the need to ensure that the GT is operated at a condition where emissions from the gas turbine can meet environmental regulations, either directly off of the gas turbine or by being treated in the HRSG.

New power plants may be able to design in the further reduced operating loads into their equipment design but only by greatly increasing costs due to more materials and equipment. This design adjustments may allow for increased range of operation, but the operation still suffers from poor efficiency.

In traditional combined cycles, desuperheaters can be employed to elevate desuperheating water flow to be introduced into the steam network in an attempt to ensure that design temperatures are not exceeded. At low(er) gas turbine conditions, there exists a point at which additional desuperheater water cannot be added due to the desuperheater effluent encroaching upon the saturation temperature of the steam (i.e., additional water will not evaporate in the system). The use of superheaters and reheaters with HRSGs are illustrated in U.S. Pat. Nos. 8,820,078 and 9,435,228, both of which are incorporated by reference as if fully set forth herein. There is a need in HRSG operation to increase the operational flexibility and reduce the inefficient and wasteful characteristics of off design performance.

There is a need for a method/system which can allow power plants (new and old) to have a broader operating range while not greatly sacrificing efficiency and while still meeting emission requirements.

SUMMARY OF THE PRESENT DISCLOSURE

The cooling system described in the present disclosure provides several advantages over the typical gas turbine exhaust gas treatment system and/or Heat Recovery Steam Generator (HRSG). Through use of disclosed system to cool turbine exhaust gas, the turbine exhaust gas temperature is controllable to be within the range for treatment with one or more catalysts (e.g., catalyst treatment of carbon monoxide, selective catalytic reduction, SCR, treatment of nitrogen oxides, etc.). The use of a working fluid as described herein to cool turbine exhaust gas prior to catalytic treatment also allows for greater control over the temperature of the turbine exhaust gas at one or more positions. For example, a working fluid can be used to control the turbine exhaust gas temperature prior to treatment for carbon monoxide at a first location and within a first temperature range, and the temperature of the turbine exhaust gas can be controlled at a second location prior to treatment for nitrous oxides and within a second, different temperature range. Controllability allows for the optimum temperature for different catalytic reactions.

Furthermore, during a typical combined cycle plant start-up, the large mass of the HRSG steel takes considerable time to heat up and must be done in a manner so as to not damage the HRSG. This means the heat output from the gas turbine must be controlled/restricted during start-up. The start-up time of a combined cycle represents a period of high cost due to low or zero steam/power production until the plant is able to be placed in service. Furthermore, many gas turbines have elevated emissions at the lower operating loads often required during start-up meaning that the plant risks exceeding required emission rates during this period of operation. The disclosed invention allows for removing heat from the exhaust gas at the inlet of the HRSG in a controlled manner so that the gas turbine may start in an unrestricted or less limited manner while also allowing the HRSG to be started in a manner required to ensure safe operation and limit potentially damaging stresses that could reduce the operational life of the HRSG. The energy removed from the inlet of the HRSG may be stored and recovered during later operation when there is a need for increased power or as a means to reduce energy input from the gas turbine for a period of time subsequently making the power plant more efficient.

Thus, the controllability provided by the use of a working fluid to cool turbine exhaust gas allows for a decrease in energy consumption in comparison to the use of other techniques (e.g., forced induction fans in simple cycle operations), and the use of controllable cooling by a working fluid allows for optimization of the catalytic reactions used to treat the turbine exhaust gas. These advantages of the presently described turbine exhaust gas treatment system allow for these and/or other benefits. Use of a working fluid to cool turbine exhaust gas also provides an advantage in that the heat of the turbine exhaust gas can be removed and captured by working fluid or redistributed to areas within the HRSG to facilitate startup of the HRSG or catalyst. For example and not by way of limitation, the heat captured in the inlet of the HRSG may be directed to be discharged in a separate coil located at the inlet of an SCR catalysts. In this manner, the exhaust moving through the coil will recover the heat from the SCR inlet coil and carry this heat directly into the SCR catalyst. This arrangement allows for much of the HRSG inlet exhaust gas energy to effectively bypass the heating surface upstream of the catalyst, which can be problematic for the plant operation as disclosed earlier and heat up the catalyst more quickly thus allowing for the reduction of gas emissions to occur earlier in the start-up of the plant.

In a similar manner to the fast catalyst start-up, the recovered inlet heat may be distributed (directly from upstream coil or from stored recovered energy from thermal energy storage system) upstream of a specific heating surface (e.g. an evaporator coil) thus allowing for the heat up of the associated thicker steel components to occur in a more controlled fashion (i.e. not subject to the unrestricted heat input from a non-limited gas turbine start-up), thus limiting the imposed thermal stresses into the coil which can lead to premature failures. This operation similarly reduces the amount of any water injection into the HRSG steam flow by bypassing heat around the superheater and reheater coils located upstream of the targeted heat up HRSG coil. The energy removed from the turbine exhaust gas can be recovered directly by a mechanical connection to a device such as a pump (e.g., the pump being driven by the working fluid), indirectly using expansion through a suitable device connected to an electrical generator (e.g., the working fluid driving an energy recovery turbine coupled to a generator), or the heat recovered by the working fluid can be used to heat up a separate process fluid (e.g., using a heat exchanger to transfer heat from the working fluid to the separate process fluid).

Further embodiments of the cooling system described herein for Heat Recovery Steam Generators (HRSG) allow for an increased range of operation of the power plant while promoting higher power plant efficiency. In such power plants, as power demand decreases the gas turbine output is reduced. The reduction in the gas turbine power output results in a reduction in the hot exhaust gas flow from the turbine and an increase in the exhaust gas temperature into the HRSG. This in turn results in the HRSG performing off design and at lower efficiency. The cooling system of this disclosure provides a control coil at the entrance to the HRSG that is independent of the coils of the HRSG. The control coil can be run at any load (any adjusted rate of fluid flow through the coil) to remove required heat from the gas turbine exhaust entering the HRSG to reduce the exhaust gas temperature. This allows the HRSG to operate safely and efficiently behind the reduced power gas turbine. The heat recovered by the control coils may be directed to a thermal energy storage system (TESS) where the heat is stored until operations of the HRSG can make use of the stored heat energy to address peak load conditions or other process needs. The inlet control coil works to control and limit the high heat of the gas turbine exhaust input into the HRSG. The control coil can then be controlled to allow the heating up of the HRSG by controllably reducing the rate of cooling fluid flow through the coils. The disclosure's use of a dedicated heating surface coil (control coil), or set of such coils each individually designed, in which the flow through the coil(s) is independent of the steam production from the evaporator portion of the boiler. In contrast, with traditional coils, the steam flow passing through the superheater/reheater heating coils is dictated by the steam production in the dedicated evaporator section(s) of the HRSG/boiler.

The use of the controlling coil, through which a heating fluid, gas or supercritical fluid is passed, reduces, and can eliminate, the need for excessive desuperheating at low loads, while not suffering operation limits imposed by physical limits. For instance, the heat recovered by the supercritical fluid/heating fluid passing through the control coil may not even have a saturation temperature impact (i.e., working fluid could be single phase). Additionally, the heat recovered by the control coils may be directed to a thermal energy storage system so that there would be no need to temper the temperature of the fluid at the outlet of the HRSG controlled coils.

The disclosure thus addresses the restricted ability of combined cycle to operate at lower power output loads, which is being required more and more as renewable energy is brought onto the national electric grid The disclosure reduces the extended time frames at startup of the plant to get the emissions system into compliance.

The disclosure also helps to minimize the amount of desuperheater water required during off design (e.g., part load or different ambient conditions) which in turn reduces the chance for erosion of HRSG and steam turbine components. The reduction in desuperheater spray water also helps to improve the boiler efficiency by reducing the amount of cooler water used for desuperheater spray, which reduces the amount of steam produced in the highest pressure system.

This reduction in steam production is aggravated when spraying into reheater coils upstream of an evaporator, so that the disclosure can have even greater benefit for systems with reheater coils.

Other benefits and features of the system of the present disclosure will be apparent in view of the disclosed matter hereinafter.

BRIEF DESCRIPTION OF THE DRAWINGS

Corresponding reference characters and symbols indicate corresponding parts throughout the several views of the drawings.

DETAILED DESCRIPTION

Figure 1:
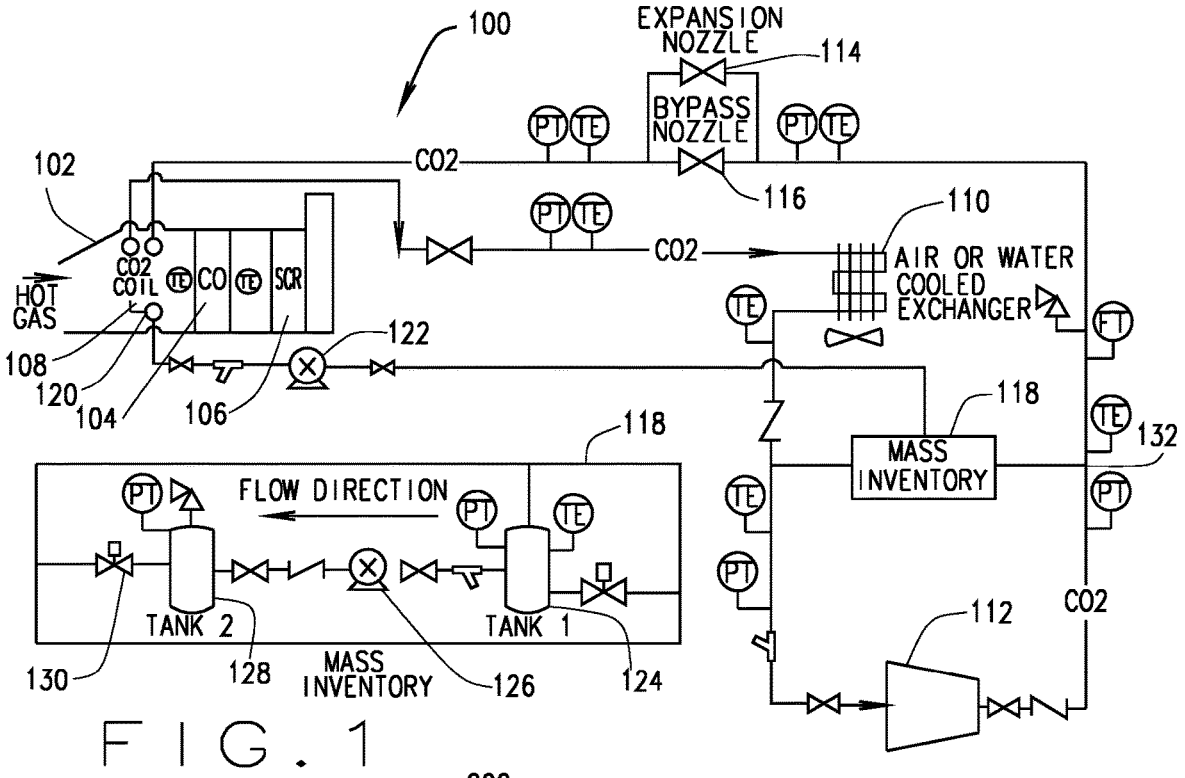
FIG. 1 is a schematic view of a gas turbine exhaust gas treatment system including catalytic treatment devices and a carbon dioxide cooling system for cooling turbine exhaust gas, with an expanded view of the mass inventory management system shown to the lower left.

The following detailed description illustrates the claimed gas turbine exhaust gas treatment system and associated methods by way of example and not by way of limitation. The description enables one of ordinary skill in the relevant art to which this disclosure pertains to make and use the turbine exhaust gas treatment system. This detailed description describes several embodiments, adaptations, variations, alternatives, and uses of the turbine exhaust gas treatment system, including what is presently believed to be the best mode of implementing the claimed turbine exhaust gas treatment system and associated methods. Additionally, it is to be understood that the disclosed turbine exhaust gas treatment system is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Referring generally to FIGS. 1-8, the turbine exhaust gas treatment system uses a working fluid to treat turbine exhaust gas. As used herein, the terms "turbine exhaust gas" should be understood to be gas from or related to any process such as combustion (e.g., related to power production), chemical production, oil cracking, steel production, or other process that uses or produces as a byproduct a turbine exhaust gas. Referring again to a simple cycle turbine facility, such facilities use only a singular thermodynamic cycle (e.g., Brayton cycle) employed such that the hot exhaust gases from the gas turbine are vented directly to the atmosphere. If emission reductions are required in a simple cycle plant, often large forced draft fans are used to mix large amounts of ambient air with the gas turbine exhaust to achieve the required catalysts operating temperatures. These fans are often expensive to procure and generally have high operating costs (e.g., electrical consumption is high).

The exhaust gas treatment system cools high temperature exhaust gases to optimum temperature ranges to promote the desired chemical reactions that take place to treat exhaust components while simultaneously protecting the catalyst systems from suffering mechanical damage due to overheating. This is achieved without use of large forced draft fans or induced draft fans. No additional atmosphere or other gases need be added to the exhaust gas, for the purpose of cooling the exhaust gasses before the exhaust gas is treated with one or more catalytic processes. In some embodiments, additional atmosphere or other gases are added indirectly to the exhaust gases, but this is not to cool the exhaust gases but is rather to facilitate the treatment of the turbine exhaust gases. For example, when treating nitrogen oxides of the turbine exhaust gas stream ammonia can be used. In such a case, the ammonia can be aqueous such that the ammonia is mixed with atmospheric air in a mixing tank where the aqueous ammonia is flashed into and diluted with the atmosphere in the mixing tank prior to injection into the turbine exhaust gas.

A heat transfer coil upstream of the catalyst system (s) is used to treat the exhaust gas to reduce the hot gas temperature to targeted ranges for safer and more efficient catalyst operation. The recovered heat removed from the host turbine exhaust gas is dissipated to ambient via air and/or water-cooled heat exchangers. Alternatively, the removed heat can be used to heat up external process streams (e.g., using a heat exchanger), recovered by mechanical application (e.g., the removed heat can drive a pump), or the removed heat can be recovered through direct expansion of the thermal working fluid using a device connected to an electrical generator (e.g., the thermal fluid can be expanded to drive a turbine which in turn drives an electrical generator). Additionally, the recovered heat may be stored and recovered at a different time for use when energy demands are higher. Additional heat transfer coils can be positioned within the gas stream to allow different turbine exhaust gas temperatures to be achieved at different points within the turbine exhaust gas stream.

This temperature control allows for improved treatment of the turbine exhaust gas. For example, typically the targeted optimum temperature range for the carbon monoxide treating catalysts does not overlap with the optimum temperature range for the nitrogen oxides treatment reactions. The temperatures for treating carbon monoxide are higher than the temperatures for treating nitrogen oxides. As a result, the carbon monoxide treatment catalyst can operate in a hotter temperature range, below an upper limit, than the SCR catalyst. The use of multiple cooling coils (e.g., heat exchangers) allows for the temperature of the turbine exhaust gas stream to be controlled to improve the effectiveness of the catalytic treatment.

In some embodiments of the turbine exhaust gas treatment system, the system uses supercritical carbon dioxide as the working fluid. This provides some specific advantages in that supercritical carbon dioxide has a high fluid density making it easy to pump around a closed cooling loop and a high heat capacity such that the system can use a lower amount of fluid passing through the heat exchanger coil for the same temperature reduction of hot turbine exhaust gas. Other suitable heat transfer working fluids including, but not limited to, thermal oils and/or water can be utilized in other embodiments of the turbine exhaust gas treatment system. The system uses cooling loops to cool the turbine exhaust gas stream to be treated. It should be understood that "cooling loop" used herein refers to the equipment used in standard cooling cycles to provide a cooled working fluid to a heat exchanger to cool the turbine exhaust gas or any other gas to be treated. For example, the cooling loop can include piping, conduits, or the like to contain and allow for the transfer of working fluid; a condenser; a pump; an expansion nozzle; an evaporator; and/or other components (e.g., a shared or dedicated mass inventory system) to provide for a cooling cycle for the turbine exhaust gas to be treated. The piping, conduits, or the like provide for fluid communication of the working fluid between the other components of the cooling loop.

Referring now to FIG. 1, one embodiment of the system 100 for treating turbine exhaust gas using a carbon dioxide working fluid is shown. Exhaust gas to be treated (e.g., from a gas turbine or other process) is received by an turbine exhaust gas discharge structure 102. The turbine exhaust gas discharge structure 102 is adapted and configured to receive turbine exhaust gas from a source (e.g., turbine) and pass the turbine exhaust gas through the turbine exhaust gas discharge structure 102. For example, the turbine exhaust gas discharge structure 102 can be hard piped to a turbine exhaust source and can be or include a pipe, duct, or other structure.

The turbine exhaust gas passing through the turbine exhaust gas discharge structure 102 passes over/through a catalytic turbine exhaust gas treatment device 104. The catalytic turbine exhaust gas treatment device 104 is positioned at least partially within the turbine exhaust gas discharge structure 102 such that turbine exhaust gas comes into contact with the catalytic exhaust gas treatment device 104. The catalytic exhaust gas treatment device 104 is adapted and configured to treat at least one component of the turbine exhaust gas through a catalytic reaction between a catalyst contained within the catalytic exhaust gas treatment device 104 and the at least one component of the turbine exhaust gas. For example, the catalytic exhaust gas treatment device 104 contains any suitable agent to react with carbon monoxide to form carbon dioxide. For example, carbon monoxide can be treated using platinum, rhodium, palladium, oxidizers generally, or any other suitable catalyst(s).

The system 100 can further include a second catalytic turbine exhaust gas treatment device 106 positioned within the turbine exhaust gas discharge structure 102 and downstream of the first catalytic turbine exhaust gas treatment device 104. The second catalytic turbine exhaust gas treatment device 106 is adapted and configured to treat at least one component of the turbine exhaust gas through a catalytic reaction between a catalyst contained within the second catalytic turbine exhaust gas treatment device 106 and the at least one component of the turbine exhaust gas. For example, the second catalytic exhaust gas treatment device 106 contains any suitable agent to react with nitrogen oxides to form one or more of water, diatomic nitrogen, or other compounds. The agent can be or include a reactant such as anhydrous ammonia, an aqueous solution of ammonia, or the like.

In some embodiments, the first catalytic turbine exhaust gas treatment device 104 is adapted and configured to treat both carbon monoxide and nitrogen oxides within the turbine exhaust gas. The first catalytic turbine exhaust gas treatment device 104 can treat both carbon monoxide and nitrogen oxides using multiple catalysts or a single catalyst. For example, in the case of a single catalyst, the first catalytic turbine exhaust gas treatment device 104 can include iron and cobalt impregnated over activated semi-coke. The catalyst is fed with carbon monoxide (e.g., from the turbine exhaust gas) to absorb or otherwise remove nitrogen oxides from the turbine exhaust gas. Other single catalysts can be used to treat both carbon monoxide and nitrogen oxide such as a barium-promoted copper chromite catalyst or any other suitable catalyst.

In order to reduce the temperature of the turbine exhaust gas to within a range suitable for treatment with the catalytic exhaust gas treatment device 104, the system includes a first heat exchanger 108. The first heat exchanger 108 is positioned at least partially within the turbine exhaust gas discharge section 102 and upstream of the catalytic turbine exhaust gas treatment device 104. The first heat exchanger 108 is adapted and configured to remove heat from turbine exhaust gas passing through the turbine exhaust gas discharge structure 102 by transferring heat to a working fluid (e.g., carbon dioxide) passing through and within the first heat exchanger 108. The working fluid passes through a cooling loop to continuously (e.g., on demand) provide cooling to the turbine exhaust gas during operation of the system 100 for treating turbine exhaust gas. It should also be understood that the turbine exhaust gas can be cooled for a purpose other than improving the treatment of the turbine exhaust gas (e.g., for the reduction in carbon monoxide and/or nitrogen oxides). For example, the turbine exhaust gas can be cooled to maintain the turbine exhaust gas within a specific temperature range irrespective of a temperature range for treating the turbine exhaust gas. This can allow for processing of the turbine exhaust gas into other products or other uses of the turbine exhaust gas such as controlling heat input into the combined cycle.

Cooled working fluid passes through the first heat exchanger 108 and leaves the first heat exchanger 108 with additional heat. The working fluid leaving the first heat exchanger enters a second heat exchanger 110 positioned downstream of the first heat exchanger 108. The second heat exchanger 110 is adapted and configured to remove heat from the working fluid gained at the first heat exchanger 108. The second heat exchanger 110 can be a condenser that facilitates a phase change of the working fluid from a gas or partial gas exiting the first heat exchanger 108 to at least partially a liquid exiting the second heat exchanger 110. This can facilitate pumping of the working fluid. Alternatively, the second heat exchanger 110 simply removes heat from the working fluid.

In some embodiments, the second heat exchanger 110 is an air-cooled heat exchanger, and in other embodiments the second heat exchanger 110 is a water-cooled heat exchanger. The second heat exchanger 110 can include a fan passing air over the second heat exchanger 110. The second heat exchanger 110 can transfer heat to the atmosphere. In some embodiments, the second heat exchanger 110 can be or include a cooling tower or evaporative cooler.

The working fluid (e.g., carbon dioxide) leaving the second heat exchanger 110 is received at a pump 112 positioned downstream of the second heat exchanger 110. The pump 112 is adapted and configured to drive the working fluid through the cooling loop. The pump 112 can be driven by an electric motor such as a variable frequency drive motor. The pump 112 is adapted and configured to pump supercritical carbon dioxide (or any other applicable fluid). In alternative embodiments (described later with reference to other Figures herein), the working fluid can change phases within the cooling loop and the pump 112 can be adapted and configured to pump a mixed phase working fluid. The pump 112 can compress the working fluid or can simply pump the working fluid.

The pump 112 drives the carbon dioxide working fluid through the cooling loop to an expansion nozzle 114. The expansion nozzle 114 is positioned downstream of the pump 112 and upstream of the first heat exchanger 108. The expansion nozzle 114 is adapted and configured to expand the supercritical carbon dioxide working fluid to reduce the temperature of the working fluid prior to the working fluid entering the first heat exchanger 108. The expansion nozzle 114 can be adapted and configured to change the phase of at least a portion of the working fluid. Alternatively, the expansion nozzle 114 expands the working fluid without the working fluid changing phase. The use of the expansion nozzle 114 reduces the temperature of the working fluid such that a lesser amount of working fluid is needed to achieve a targeted gas temperature at the inlet of the catalytic exhaust gas treatment device 104 (in comparison to a system without an expansion nozzle 114). The reduced temperature allows for use of less working fluid.

The system 100 includes a bypass loop which can include a bypass nozzle 116. The bypass loop (which can include a bypass nozzle 116) is adapted and configured to controllably and selectively permit the working fluid to bypass the expansion nozzle 114. The expansion nozzle 114 can be bypassed using the bypass 116 if sufficient cooling is being provided by the second heat exchanger 110 removing heat from the working fluid. For example, the ambient temperature can be sufficiently low that the second heat exchanger 110 provides sufficient cooling of the turbine exhaust gas. Bypassing the expansion nozzle 114 allows the system 100 to avoid or reduce the pressure drop associated with use of the expansion nozzle 114. Bypassing the expansion nozzle 114 and forgoing the associated pressure drop increases efficiency as the energy required to pump the working fluid is reduced when the pressure is maintained.

In embodiments including a bypass nozzle 116, the bypass is adapted and configured to bypass the expansion nozzle 114 such that the working fluid is expanded by the bypass expansion nozzle 116 instead. The bypass nozzle 116 is adapted and configured to expand the working fluid to a lesser degree than the expansion nozzle 114. Alternatively, the bypass nozzle 116 can expand the working fluid to a greater degree than the expansion nozzle 114 such that the expansion nozzle 114 is bypassed when additional cooling is desired to maintain the exhaust gas temperature within a range suitable for treatment as described herein. In another embodiment, the bypass nozzle 116 can be designed so to minimize or reduce expansion of the fluid passing through the bypass. The bypass valve and the expansion nozzle functionally can be a throttling valve or fixed device and can be manually or automatically actuated.

The system 100 further includes a mass inventory management system 118. The mass inventory management system 118 is adapted and configured to manage the amount of working fluid within the cooling loop that includes the first heat exchanger 108. The mass inventory management system 118, in order to manage the amount of working fluid in the cooling loop, is adapted and configured to controllably receive working fluid from downstream of the first heat exchanger 108. The mass inventory management system 100 is still further adapted and configured to add or remove working fluid from the cooling loop.

The mass inventory management system 118 controllably removes working fluid from downstream of the first heat exchanger 108 (e.g., using a controllable valve) at a takeoff point 120. Working fluid removed from the cooling loop at the takeoff point 120 passes through a valve to a pump 122. The pump 122 drives the working fluid from the takeoff point 120 to the mass inventory management system 118. The working fluid pumped by the pump 122 passes through a further valve on the way to the mass inventory management system 118.

In the expanded schematic of the inventory management system in FIG. 1, the working fluid is received in a first tank 124 of the mass inventory management system 118. The first tank 124 can store the working fluid and/or can function as a temporary receiving tank. The first tank is drainable by a mass inventory pump 126. The working fluid leaving the first tank 124 passes through a check valve positioned between the first tank 124 and the mass inventory pump 126.

The mass inventory pump 126 is controllable to supply a second tank 128 of the mass inventory management system 118 with working fluid. The second tank 128 can operate as storage tank for the working fluid. Working fluid driven by the pump 126 passes through a check valve and/or an additional valve on the way to the second tank 128.

A controllable valve 130 (e.g., the valve can be an open/close discrete valve with a generally fixed flow restriction but also can be an active flow control valve with flow controlling characteristic permitting variable flows) is positioned downstream of the second tank 128 to control the addition of working fluid into the cooling loop. The controllable valve 130 is positioned to discharge working fluid from the mass inventory management system 118 into the cooling loop downstream of the second heat exchanger 110 and upstream of the pump 112. The mass inventory management system 118 is also adapted and configured to controllably receive working fluid from the cooling loop at a second takeoff point 132 positioned downstream of the pump 112 and upstream of the expansion nozzle 114.

Still referring to FIG. 1, the system 100 includes a variety of sensors for use in controlling the pumped flow of working fluid to the first heat exchanger 108, the pump 112, the mass inventory management system 118, or the like. Sensors shown in FIG. 1 with the abbreviation "PT" are or include a pressure transducer adapted and configured to measure the pressure of the working fluid at that point in the system 100. Sensors shown with the abbreviation "TE" are or include a temperature element (e.g., a thermocouple, thermistor, or the like) adapted and configured to measure the temperature of the working fluid or the temperature of the turbine exhaust gas in the system 100. Sensors shown with the abbreviation FT are or include a flow transmitter/flow meter (e.g., an anemometer, magnetic flow meter, turbine flow meter, rotameter, spring and piston flow meter, or the like). The system 100 can also employ additional and/or different types of process measurements to control the system and/or provide process conditions for data collection and system optimization.

Using these sensors and controllable devices (e.g., valves), the system 100 is controlled in operation. The system 100 is primarily controlled based on the turbine exhaust gas temperature entering the catalytic turbine exhaust gas treatment device 104 located within the hot turbine exhaust gas stream and within the turbine exhaust gas discharge structure 102. The system can also or alternatively be controlled based on the turbine exhaust gas temperature entering the second catalytic turbine exhaust gas treatment device 106. The set point temperature for the hot turbine exhaust gas temperature at the catalyst face (e.g., at the entrance to the first and/or second catalytic turbine exhaust gas treatment device) is used to modulate the variable frequency drive motor driving the pump 112. This in turn controls the flow rate of the working fluid around the cooling loop with more flow being provided when the turbine exhaust temperature at the catalyst face is hotter than the set point. In alternative embodiments, the pump 112 is not driven by a variable frequency drive motor and instead a flow control valve is positioned downstream of the pump 112. Such a flow control valve is used to control the flowrate of the working fluid through the cooling loop to in turn control the temperature of the turbine exhaust gas.

In some embodiments, the system 100 is controlled by having a flow rate set by controlling the turbine exhaust gas temperature at the face of the catalytic turbine exhaust gas treatment device 104 with the working fluid passing through the bypass valve 116. When the pump flow rate reaches a predetermined level, the flow can be modulated through the bypass valve 116 so as to control the temperature of the turbine exhaust gases at the face of the catalytic turbine exhaust gas treatment device 104.

In embodiments of the system 100 including a heat exchanger utilizing a fan (e.g., the second heat exchanger 110), the sequencing of the fan ON/OFF within the heat exchanger can be used to optimize or reduce power consumption and/or for further temperature control of the working fluid. For example, on colder days it is possible to turn off the fan(s) as the working fluid temperature can be suitably low enough to achieve the desired turbine exhaust gas temperature at the face of the catalyst. Additionally, in some embodiments one or more heat exchangers can be bypassed, in full or in part, and any corresponding fan can be cycled down. Selectively bypassing one or more ambient air heat exchangers allows for further temperature control of the working fluid prior to entering the heat exchanger 108 located in the hot turbine exhaust gas stream. Bypassing one or more ambient air heat exchangers also allows for a reduction in power consumption by the pump 112 due to a lower total pressure drop for the closed working fluid loop flow path.

For applications using CO2 (e.g., system 100 shown in FIG. 1), the mass inventory management system 118 can be operated to maintain the CO2 working fluid in the supercritical state (T>32° C., 77 bar) or in the liquid state throughout the complete working loop. However, it should also be understood that the use of an expansion valve/nozzle 114 can result in a 2-phase fluid including vapor being introduced to the first heat exchanger 108 (e.g., a transfer coil inside the hot gas stream). With CO2 working fluid, the mass inventory management system 118 is controlled based on the temperature at the inlet to the pump 112 and is controlled to manage the pressure at this location by adding or subtracting mass from the closed cooling loop system to ensure that the fluid state at the inlet of the pump 112 is either supercritical (hotter ambient days, typically T>28° C.) or liquid phase (cooler ambient days, typically T<28° C.).

Referring now generally to FIGS. 2-8, different embodiments of the system 100 are shown and are later described. Components shown similarly to those in FIG. 1 are the same or substantially similar unless otherwise described as follows. For example, in FIG. 2 the first heat exchanger 208 is the same as the first heat exchanger 108 described with reference to FIG. 1.

Figure 2:
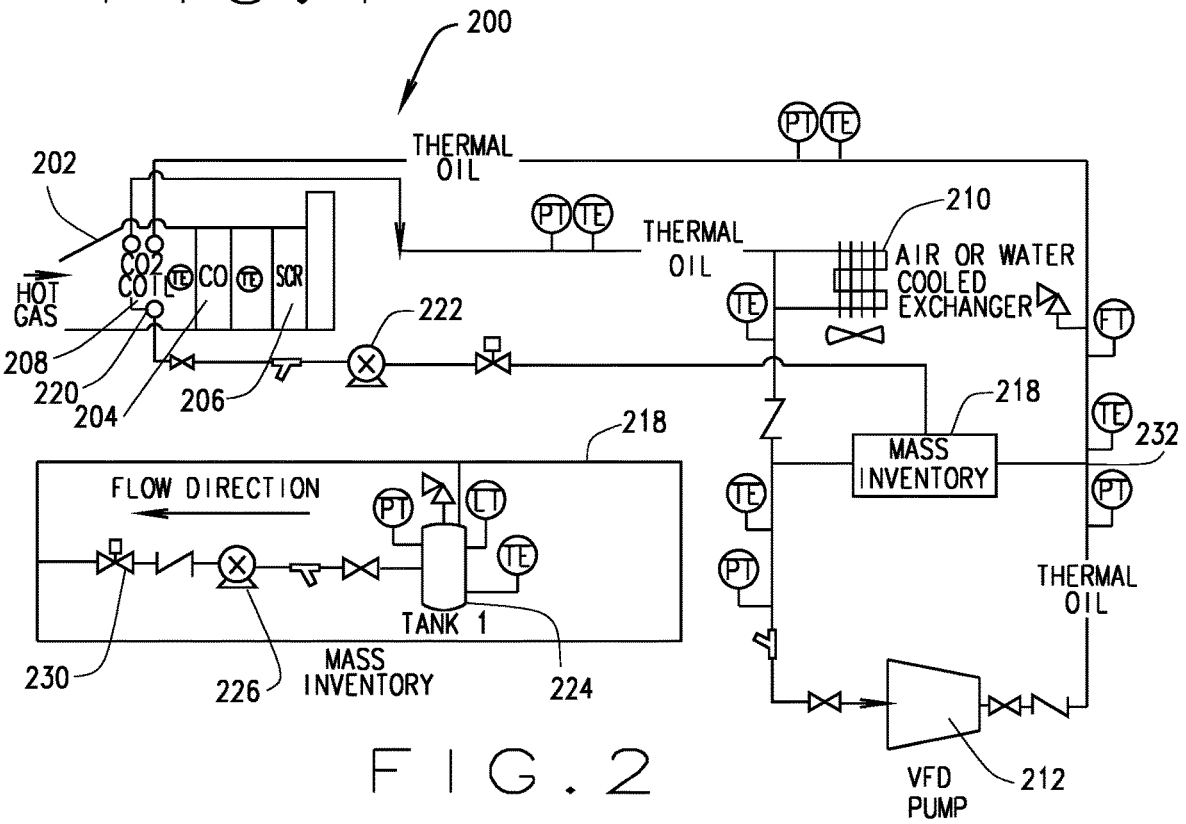
FIG. 2 is a schematic view of an alternative embodiment of the turbine exhaust gas treatment system of FIG. 1 in which thermal oil is used as the working fluid.

Referring now specifically to FIG. 2, a turbine exhaust gas treatment system 200 is shown which is a variant of the turbine exhaust gas treatment system 100 shown in FIG. 1. Instead of using carbon dioxide as a working fluid (e.g., as in the system 100), the system 200 uses thermal oil as the working fluid. The system 200 notably does not include an expansion nozzle and does not include a bypass nozzle. The thermal oil working fluid is not expanded prior to entering the first heat exchanger 208. The system 200 also differs from the system 100 in that the second heat exchanger 210 can be selectively bypassed through control of the system 200.

The system 200 further differs in that the mass inventory management system 218 includes only a single tank 224. The tank 224 is monitored by a level transmitter (LT) and the amount of thermal oil in the cooling loop is controlled to control the system 200 overall as described with reference to FIG. 1.

Figure 3:
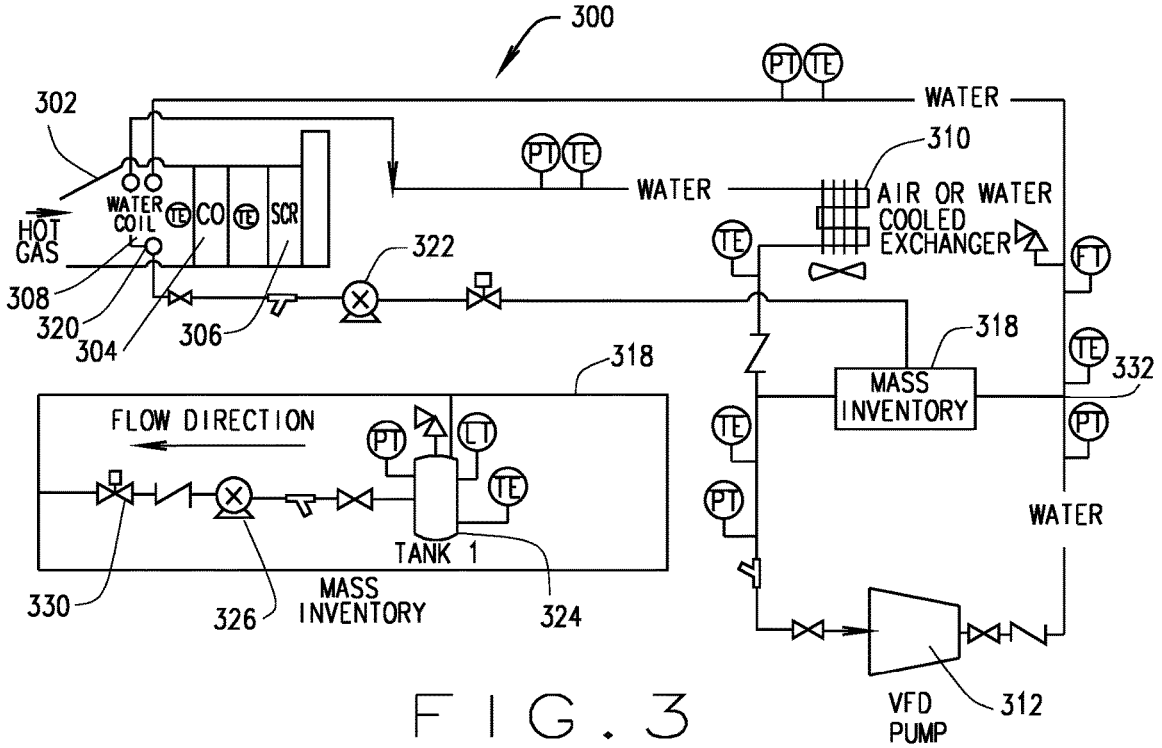
FIG. 3 is a schematic view of an alternative embodiment of the turbine exhaust gas treatment system of FIG. 1 in which water is used as the working fluid.

Referring now to FIG. 3, a turbine exhaust gas treatment system 300 is shown which is a variant of the turbine exhaust gas systems 100, 200 shown in FIGS. 1-2. The turbine exhaust gas treatment system 300 varies from the turbine exhaust gas system 200 shown in FIG. 2 in that water is used as the working fluid. The turbine exhaust gas treatment system 300 further varies in that it does not include a bypass of the second heat exchanger 310.

Figure 4:
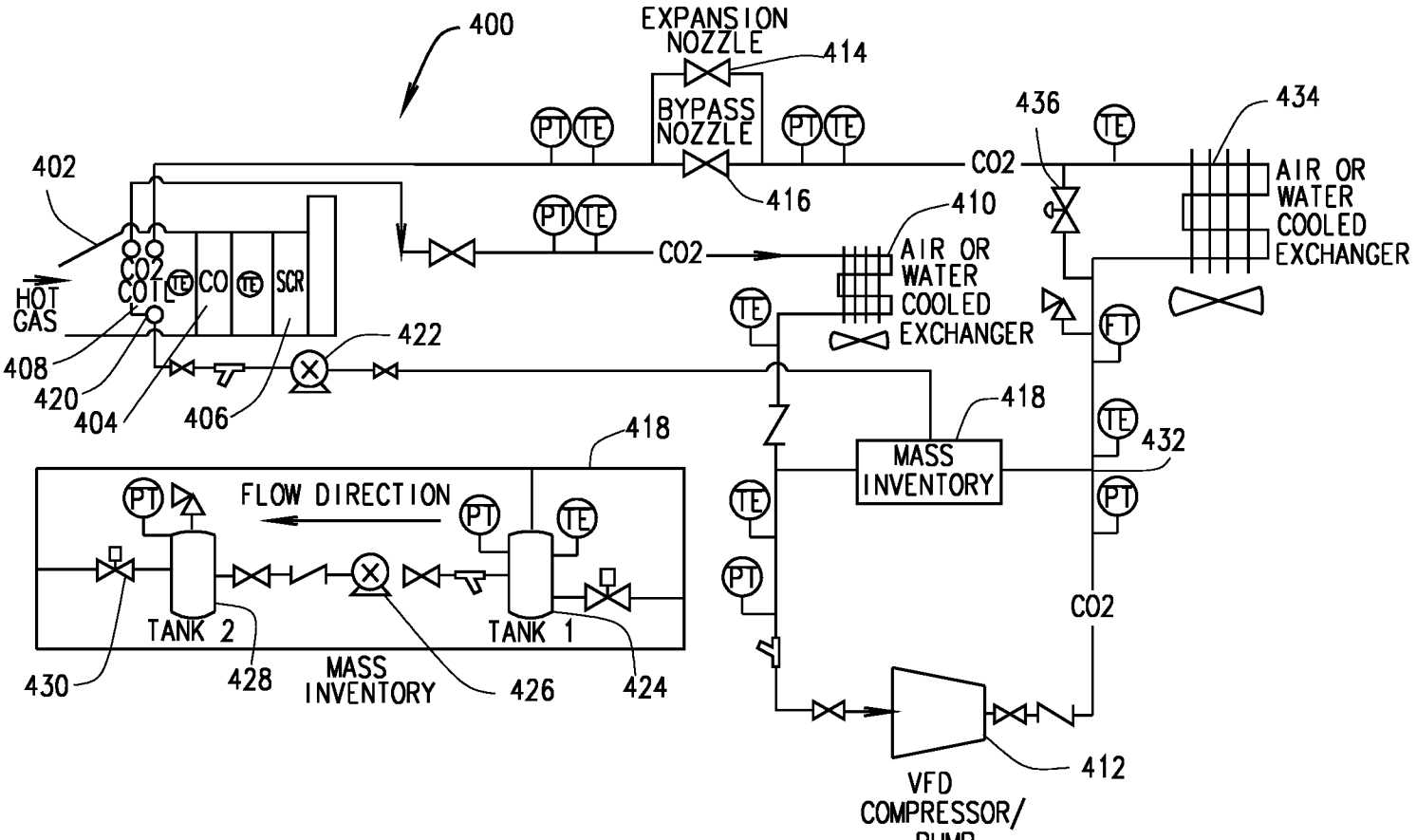
FIG. 4 is a schematic view of an alternative embodiment of the turbine exhaust gas treatment system of FIG. 1 including a heat exchanger positioned between a pump and an expansion nozzle.

Referring now to FIG. 4, a turbine exhaust gas treatment system 400 is shown which is a variant of the turbine exhaust gas system 100 shown in FIG. 1. The turbine exhaust gas treatment system 400 uses carbon dioxide as a working fluid. The turbine exhaust gas treatment system 400 differs from the turbine exhaust gas treatment system 100 in that the turbine exhaust gas treatment system 400 includes a third heat exchanger 434 and additional sensors associated with the third heat exchanger 434 (e.g., a temperature sensor downstream of the third heat exchanger 434 and upstream of the expansion nozzle 414).

The third heat exchanger 434 is positioned downstream of the pump 412 and is adapted and configured to remove heat from the working fluid. The third heat exchanger 434 is either air cooled, or water cooled. The third heat exchanger 434 can include a fan to pass ambient air over/through the third heat exchanger 434 such that heat is moved from the working fluid to the ambient atmosphere. As explained with regard to FIG. 1, the fan is controllable to minimize power consumption while maintaining the temperature of the turbine exhaust gas within suitable ranges for treatment with catalyst-based turbine exhaust gas treatment devices, e.g., one or more SCR devices. For example, the fan can be controlled based on the temperature of the working fluid upstream of the third heat exchanger 434, the temperature of the working fluid downstream of the third heat exchanger 434, and/or the temperature of the turbine exhaust gas prior to the first and/or second catalytic exhaust gas treatment device.

The system 400 also includes a bypass valve 436, which can be manual or actuated, adapted and configured to controllably and selectively permit the working fluid to bypass the third heat exchanger 434. The bypass 436 is controlled based on one or more of the inputs described directly above with respect to the control of the fan of the third heat exchanger 434 and/or other factors as generally described for earlier embodiments. The third heat exchanger 434 can be bypassed or partially bypassed to increase the efficiency of the system 434 through decreased power consumption of the associated fan and/or through a lower total pressure drop in the cooling loop. The third heat exchanger 434 is only bypassed when suitable turbine exhaust gas temperature can be maintained without use of the third heat exchanger 434.

Figure 5:
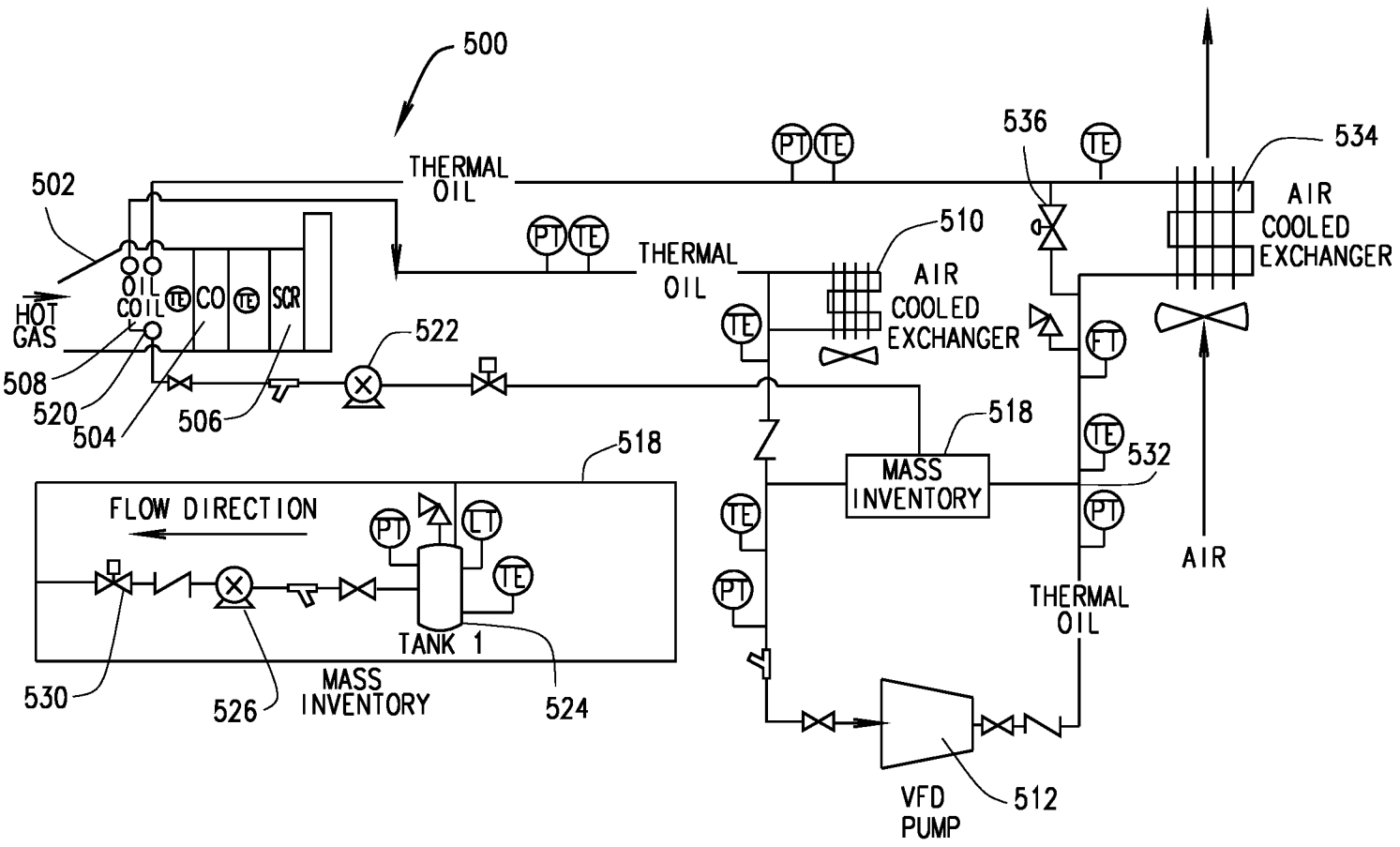
FIG. 5 is a schematic view of an alternative embodiment of the turbine exhaust gas treatment system of FIG. 4 in which thermal oil is used as the working fluid.

Referring now to FIG. 5, a turbine exhaust gas treatment system 500 is shown which is a variant of the turbine exhaust gas system 200 shown in FIG. 2 which includes a third heat exchanger 534 and bypass 536 of the type described with respect to FIG. 4. The turbine exhaust gas treatment system 500 differs from the system 200 in that it includes the third heat exchanger 534. The turbine exhaust gas treatment system 500 differs primarily from the system 400 in that the working fluid is thermal oil. The system 500 has the advantages of the system 200 and the system 400 but uses thermal oil instead of carbon dioxide (as in the system 400).

Figure 6:
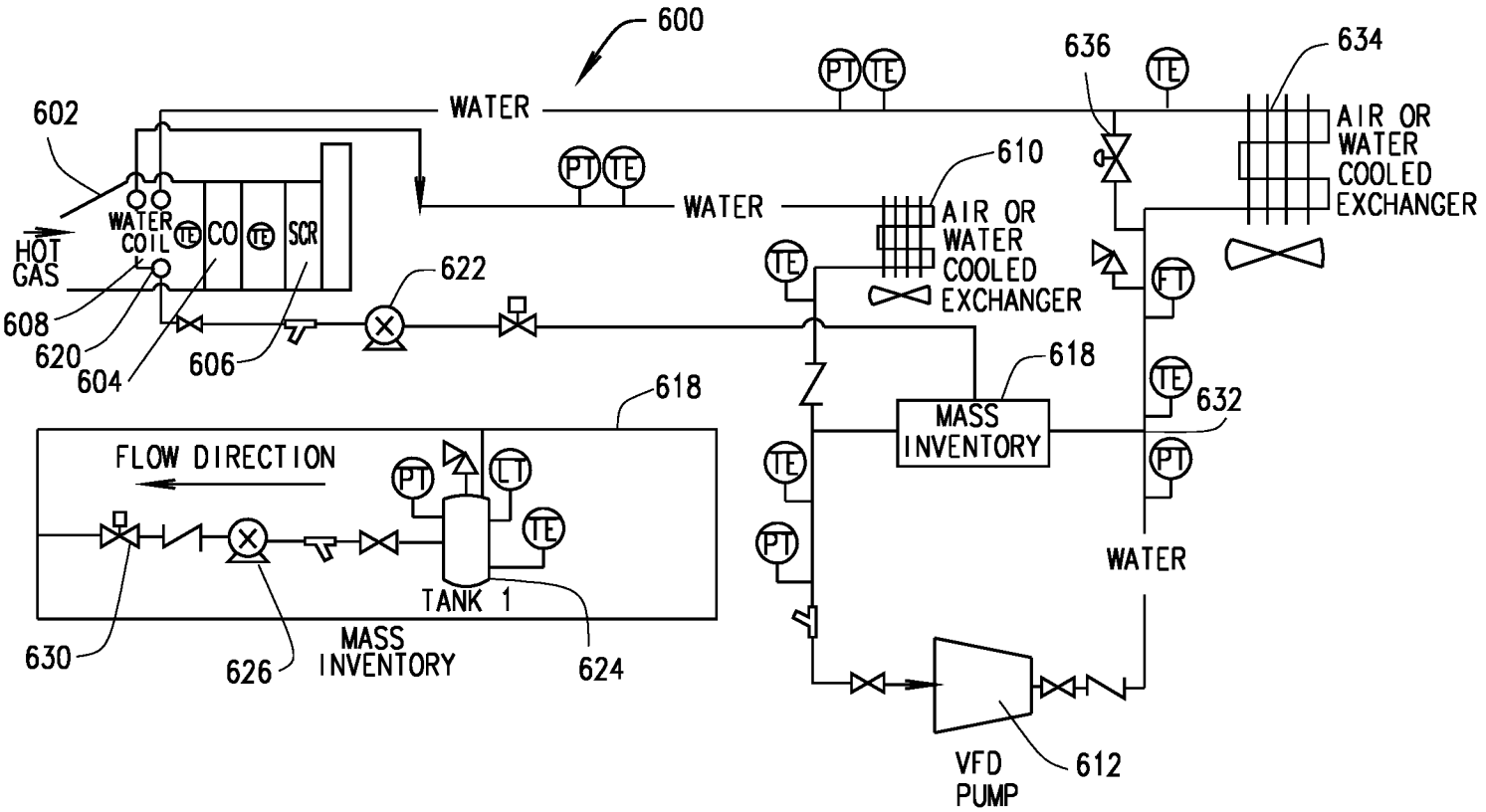
FIG. 6 is a schematic view of an alternative embodiment of the turbine exhaust gas treatment system of FIG. 4 in which water is used as the working fluid.

Referring now to FIG. 6, a turbine exhaust gas treatment system 600 is shown which is a variant of the turbine exhaust gas system 300 shown in FIG. 3 which includes a third heat exchanger 634 and bypass 636 of the type described with respect to FIG. 4. The turbine exhaust gas treatment system 600 differs from the system 300 in that it includes the third heat exchanger 634. The turbine exhaust gas treatment system 600 differs primarily from the system 400 in that the working fluid is water. The system 600 has the advantages of the system 300 and the system 400 but uses water instead of carbon dioxide (as in the system 400).

Figure 7:
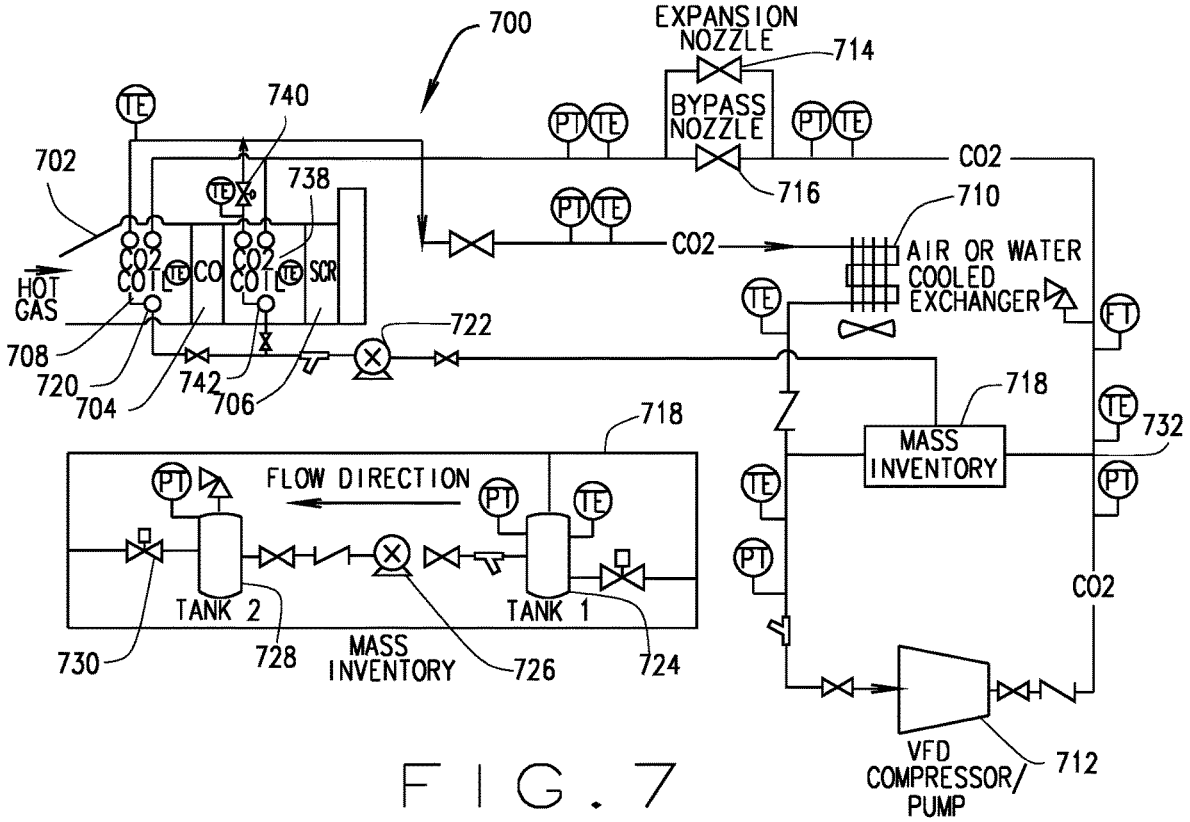
FIG. 7 is a schematic view of an alternative embodiment of the turbine exhaust gas treatment system of FIG. 1 in which split cooling is used to cool turbine exhaust gas prior to a first catalytic treatment device and to further cool the turbine exhaust gas after the first catalytic treatment device and prior to a second catalytic treatment device.

Referring now to FIG. 7, a turbine exhaust gas treatment system 700 is shown which is a variant of the turbine exhaust gas system 100 shown in FIG. 1. The turbine exhaust gas treatment system 700 differs from the system 100 primarily in that the system 700 includes a fourth heat exchanger 738. The fourth heat exchanger 738 is positioned at least partially within the turbine exhaust gas discharge section 702 downstream of the catalytic exhaust gas treatment device 704. The fourth heat exchanger 738 is also upstream of the second catalytic turbine exhaust gas treatment device 706. The fourth heat exchanger 738 is adapted and configured to remove heat from the turbine exhaust gas passing through the turbine exhaust gas discharge structure 102 by transferring heat to the working fluid (e.g., carbon dioxide) passing through and within the fourth heat exchanger 738. The fourth heat exchanger is positioned within the cooling loop downstream of the pump 712 and upstream of the second heat exchanger 710. The fourth heat exchanger 738 is also downstream of the expansion nozzle 714.

The first heat exchanger 708 and the fourth heat exchanger 738 are arranged in parallel loops such that the working fluid is split, with separate portions of the working fluid passing through the first heat exchanger 708 and the fourth heat exchange 738. The separate portions of the working fluid converge to form a single flow after exiting the first heat exchanger 708 and the fourth heat exchanger 738. The combined output is received by the second heat exchanger 710. The fourth heat exchanger 738 can be adapted and configured to take off from the working fluid prior to the working fluid reaching the first heat exchanger 708 such that the fourth heat exchanger 738 is fed with priority in order to maintain, with priority, a turbine exhaust gas temperature range within operating parameters of the second catalytic exhaust gas treatment device 706. In other words, the flow of the working fluid can branch upstream of the first heat exchanger 708 and the fourth heat exchanger 738 with a portion of the working fluid being fed to the first heat exchanger 708 and a separate portion of the working fluid being fed to the fourth heat exchanger 738. This allows for separate streams of cooled working fluid to separately supply the two heat exchangers (e.g., in a parallel configuration rather than in a serial configuration where a single stream of working fluid is sequentially heated). The length and configuration of the diverging piping can be adapted and configured to feed the fourth heat exchanger 738 with priority. Alternatively, the exchangers (i.e., 708 and 738) can be in series with the same flow of coolant (e.g., CO2) passing through each exchanger with the flow direction of said fluid being either in parallel to the hot turbine exhaust gas stream or counter current with the turbine exhaust gas stream. In other words, one of either of the two heat exchangers can be fed with priority, the heat exchangers can be fed serially, or the heat exchangers can be fed in parallel.

Advantageously, the use of two heat exchangers independently cooling the turbine exhaust gas prior to different catalytic treatment devices allows for independent control of turbine exhaust gas temperature prior to independent treatment devices. This allows for the turbine exhaust gas temperature to be maintained within a first range for treatment by the first catalytic treatment device 704 (e.g., to treat carbon monoxide). The turbine exhaust gas temperature is independently maintained within a second lower temperature range for treatment by the second catalytic treatment device 706 (e.g., an SCR to treat nitrous oxides).

The fourth heat exchanger 738 and the first heat exchanger 708 can be independently controlled based on the working fluid temperature monitored at the outlet of both the first 708 and fourth heat exchanger 738. Flow of the working fluid to the first 708 and fourth heat exchangers 738 can be controlled via a temperature control valve located in the pipeline dedicated to the coil being controlled (e.g., control valve 740). Two temperature control valves can be used (one per heat exchanger) or a single control valve 740 can be used to control the flowrate of working fluid to the fourth heat exchanger 738 with the remainder of the working fluid being provided to the first heat exchanger 708 positioned downstream of the fourth heat exchanger 738.

The system 700 includes a mass inventory management system 718 adapted and configured to controllably receive working fluid downstream of the fourth heat exchanger 738 (e.g., using a controllable valve) at a takeoff point 742. Otherwise, the mass inventory system 718 operates as previously described.

Figure 8:
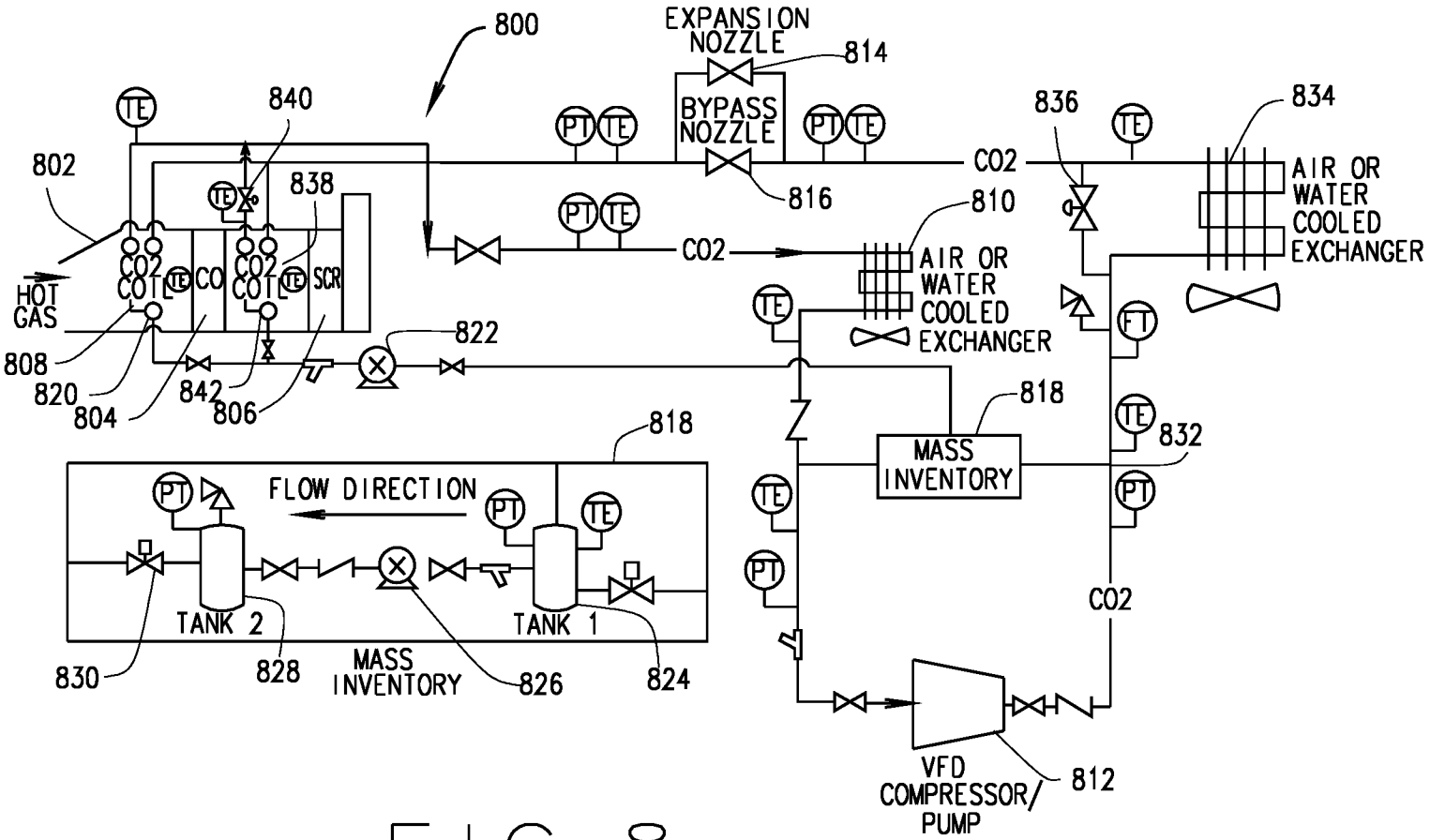
FIG. 8 is a schematic view of an alternative embodiment of the turbine exhaust gas treatment system of FIG. 7 including a heat exchanger positioned between a pump and an expansion nozzle.

Referring now to FIG. 8, a turbine exhaust gas treatment system 800 is shown which is a variant of the turbine exhaust gas system 700 shown in FIG. 7. The turbine exhaust gas treatment system 800 differs from the system 700 primarily in that the system 800 further includes a third heat exchanger 834 and bypass 836 of the type shown and described with respect to FIG. 4. This system 800 combines the benefits of the fourth heat exchanger 838 and third heat exchanger 834 previously described.

Generally, while the use of a fourth heat exchanger is shown only with respect to FIGS. 7-8, it should be understood that a fourth heat exchanger can be used with any of the systems described herein.

Figure 9A:
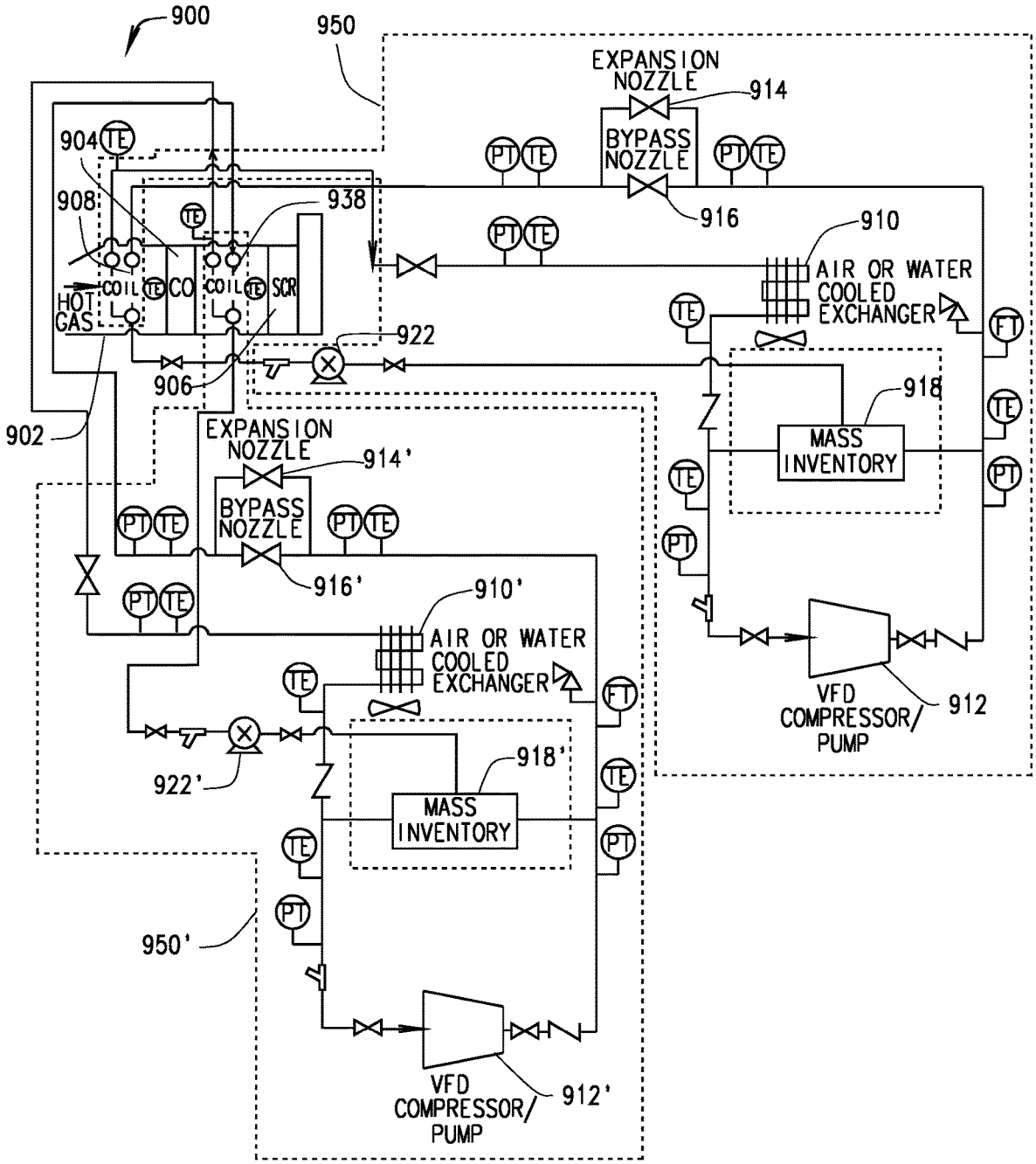
FIG. 9A is a schematic view of an alternative embodiment of the turbine exhaust gas treatment system having independent cooling loops.
Figure 9B:
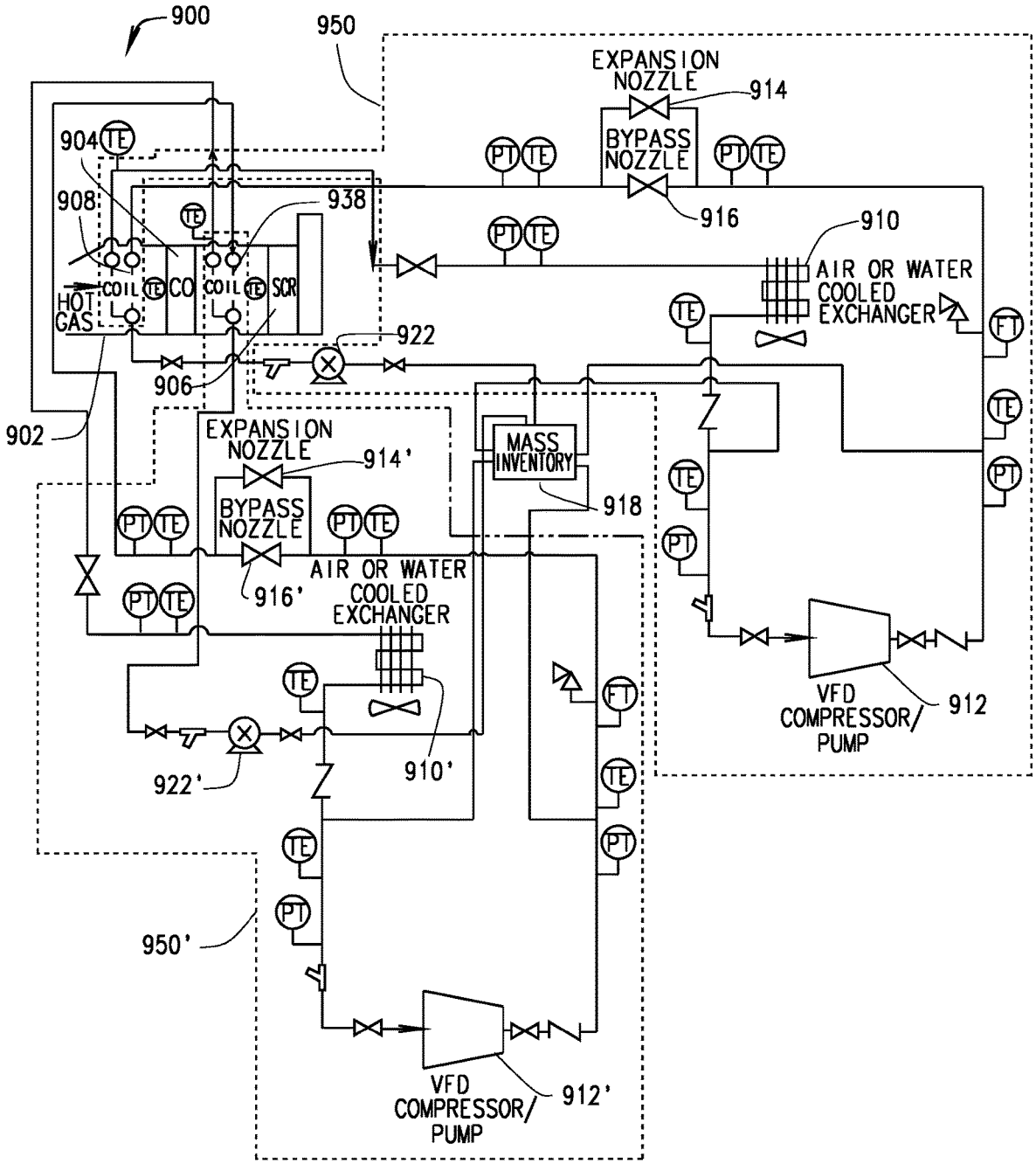
FIG. 9B is a schematic view of an alternative embodiment of the turbine exhaust gas treatment system having independent cooling loops and a common mass inventory system.
Figure 9C:
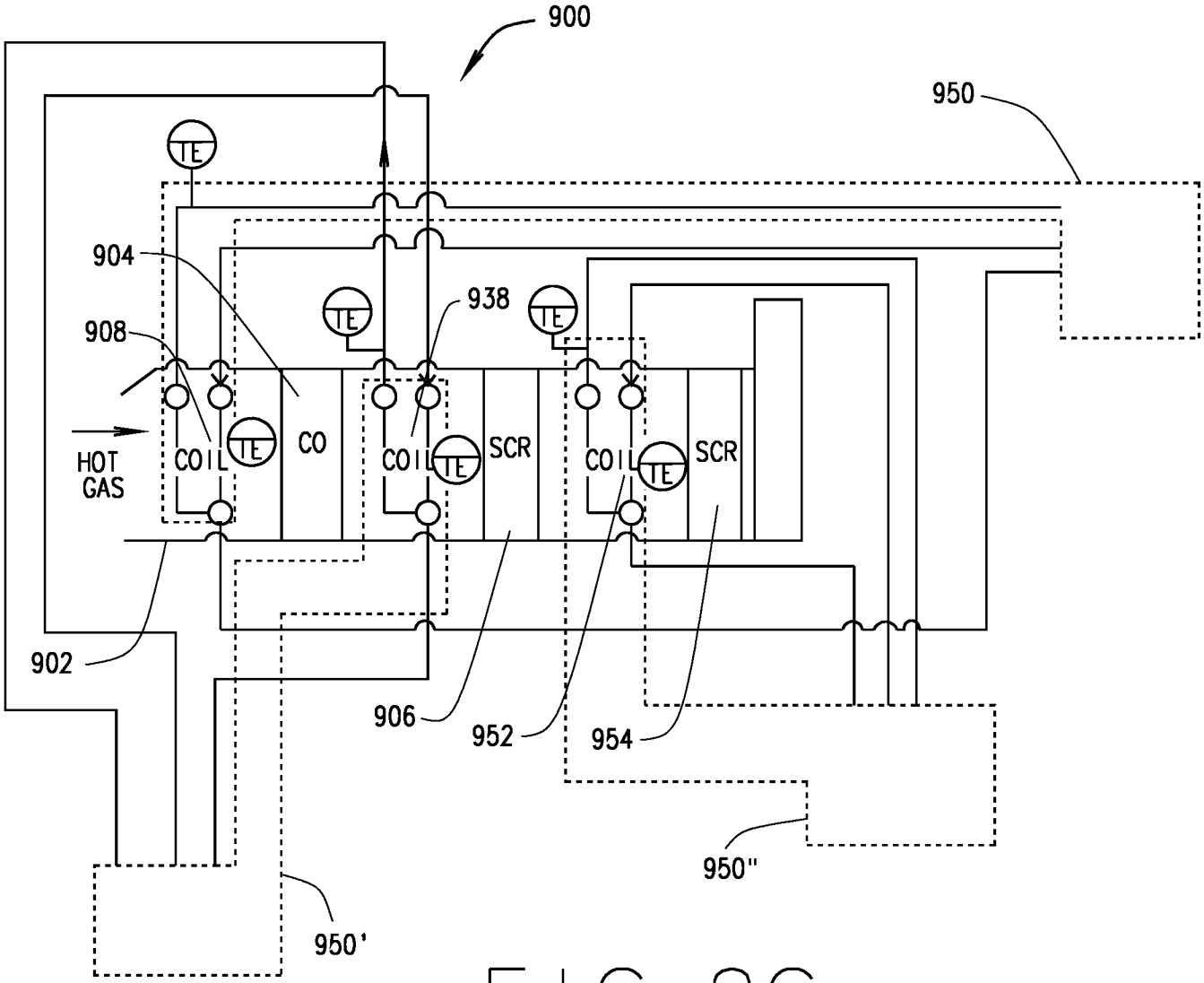
FIG. 9C is a schematic view of an alternative embodiment of the turbine exhaust gas treatment system having three or more independent cooling loops.

Referring generally to FIGS. 9A-9C, multiple independent cooling loops can be used to cool turbine exhaust gas within the turbine exhaust gas discharge structure 902. Each independent cooling loop 950, 950', 950" (shown within dashed lines) cools the turbine exhaust gas within the turbine exhaust gas discharge structure 902 using an independent heat exchanger within the turbine exhaust gas discharge structure 902. The independent cooling loop 950 cools turbine exhaust gas by supplying cooled working fluid to the first heat exchanger 908, receiving heated working fluid from the first heat exchanger 908, and cooling the heated working fluid prior to supplying it to the first heat exchanger 908. The independent cooling loop 950 further includes piping, conduits, valves, or the like illustrated in solid lines to provide for fluid communication and control of the working fluid between the other components of the cooling loop 950. The independent cooling loop 950' cools the turbine exhaust gas discharge structure 902. The independent cooling loop 950' cools turbine exhaust gas by supplying cooled working fluid to the fourth heat exchanger 938, receiving heated working fluid from the fourth heat exchanger 938, and cooling the heated working fluid prior to supplying it to the fourth heat exchanger 938. The independent cooling loop 950' further includes piping, conduits, valves, or the like illustrated in solid lines to provide for fluid communication and control of the working fluid between the other components of the cooling loop 950'.

The independent cooling loop 950 comprises at least a second heat exchanger 910 and a pump 912. Similarly, the independent cooling loop 950' comprises at least a second heat exchanger 910' and a pump 912'. Each independent cooling loop 950, 950' likewise includes a heat exchanger (first and fourth heat exchangers 908, 938) positioned within the turbine exhaust gas discharge structure 902. Each independent cooling loop 950, 950' can include other equipment of the type described herein with respect to any of the embodiments disclosed. For example, each independent cooling loop 950, 950' can include an expansion nozzle 914, 914', a bypass nozzle 916, 916', a mass inventory system 918, 918', a pump 922, 922' adapted to take off and supply the mass inventory system, etc. Each independent cooling loop 950, 950' can also include a third heat exchanger of the type described with respect to FIGS. 4-6 and 8. The mass inventory system 918, 918' can be the type described herein with respect to other embodiments disclosed herein.

It should also be understood that the system 900 including independent cooling loops 950, 950' can utilize any of the working fluids described herein (e.g., carbon dioxide, water, thermal fluid/oil, etc.). The independent cooling loops 950, 950' are independent, with independent mass inventory systems 918, 918', such that the independent cooling loops 950, 950' can use different working fluids. For example, the independent cooling loop 950 can use water as the working fluid, while the independent cooling loop 950' can use carbon dioxide as the working fluid. Any combination of working fluids can be used.

Referring now to FIG. 9B, a system 900 can include independent cooling loops 950, 950' but with a shared mass inventory system 918. This embodiment is substantially similar to that described with respect to FIG. 9A with the substantial difference being that the independent cooling loops 950, 950' share a single mass inventory system 918 and the independent cooling loops are capable of sharing a working fluid. The mass inventory system 918 can be any of the configurations described herein with reference to other embodiments and figures with suitable modifications to provide for double the inputs and outputs to account for two separate cooling loops 950, 950'. The mass inventory system 918 is adapted and configured to allow for the transfer of working fluid between the separate cooling loops 950, 950'.

Referring now to FIG. 9C, the system 900 of the types described herein can include any number of catalytic turbine exhaust gas treatment devices and any number of separate cooling loops 950, 950', and 950". For example, and as depicted in FIG. 9C, the system 900 includes three catalytic turbine exhaust gas treatment devices. A first heat exchanger 908 adapted and configured to cool turbine exhaust within the turbine exhaust gas discharge structure upstream of the first catalytic turbine exhaust gas treatment device 904 in conjunction with the separate cooling loop 950. A fourth heat exchanger 938 cools turbine exhaust gas upstream of a second catalytic turbine exhaust gas treatment device 906 in conjunction with the separate cooling loop 950'. A sixth heat exchanger 952 cools turbine exhaust gas upstream of a third catalytic turbine exhaust gas treatment device 954 in conjunction with the separate cooling loop 950". In this embodiment, each separate cooling loop 950, 950', 950" includes a distinct mass inventory system and each loop is capable of using a different working fluid. It should be understood that three or more separate cooling loops can be utilized with a single mass inventory system of the type described with reference to FIG. 9B. It should also be understood that three or more catalytic turbine exhaust gas treatment devices can be used in a system with a single cooling loop with parallel branches feeding each separate heat exchanger (e.g., as shown in at least FIG. 7).

Referring generally to FIGS. 1-9C, the systems described herein includes a plurality of heat exchangers described generally. It should be understood that the heat exchangers described herein can be of any suitable configuration. For example, any or all of the heat exchangers can be parallel flow heat exchangers, cross flow heat exchangers, counter flow heat exchangers, or any other suitable heat exchanger.

It should also be understood that the systems described herein include a plurality of catalytic turbine exhaust gas treatment devices. But in alternative embodiments, one or more of the catalytic turbine exhaust gas treatment devices can be substituted with other turbine exhaust gas treatment devices including but not limited to non-catalyst treatment system(s). Non-catalyst treatment systems can comprise a membrane adapted and configured to remove one or more compounds from the turbine exhaust, a urea injection system, or other system. For example, the membrane can be a synthetic membrane made from polymers, cellulose acetate, or ceramic materials. Any suitable material can be used for the membrane, the membrane being adapted and configured to remove carbon monoxide, nitrous oxides, sulfur dioxide, hexane, carbon dioxide, butane, methane, benzene, or other compounds.

Still referring generally to FIGS. 1-9C, the systems described herein provide the benefits described herein of improved turbine exhaust gas treatment. The systems provide increased control over the temperature of turbine exhaust gases such that the turbine exhaust gases can be treated. The systems described further provide for increased efficiency through the control of various components of the cooling subsystem used in cooling the turbine exhaust gas for treatment. Further, the systems described herein utilize a working fluid cooling system and corresponding techniques (e.g., such as refrigeration or other general cooling methods) such that the systems do not use or include a forced draft fan to mix air with the turbine exhaust gas nor does the system need to inject water into the hot turbine exhaust gas stream. This increases efficiency by eliminating the power consumption associated with a forced draft fan as well as reducing the negative effects which can occur as a result of water injection (e.g., corrosion). Similarly, the systems described do not use or include an induced draft fan. These fans are unnecessary as additional upstream air is not required to cool the turbine exhaust gas due to the use of the cooling system described herein. The systems described herein further allow for the turbine exhaust gas, once treated, to be exhausted directly to atmosphere.

Figure 10:
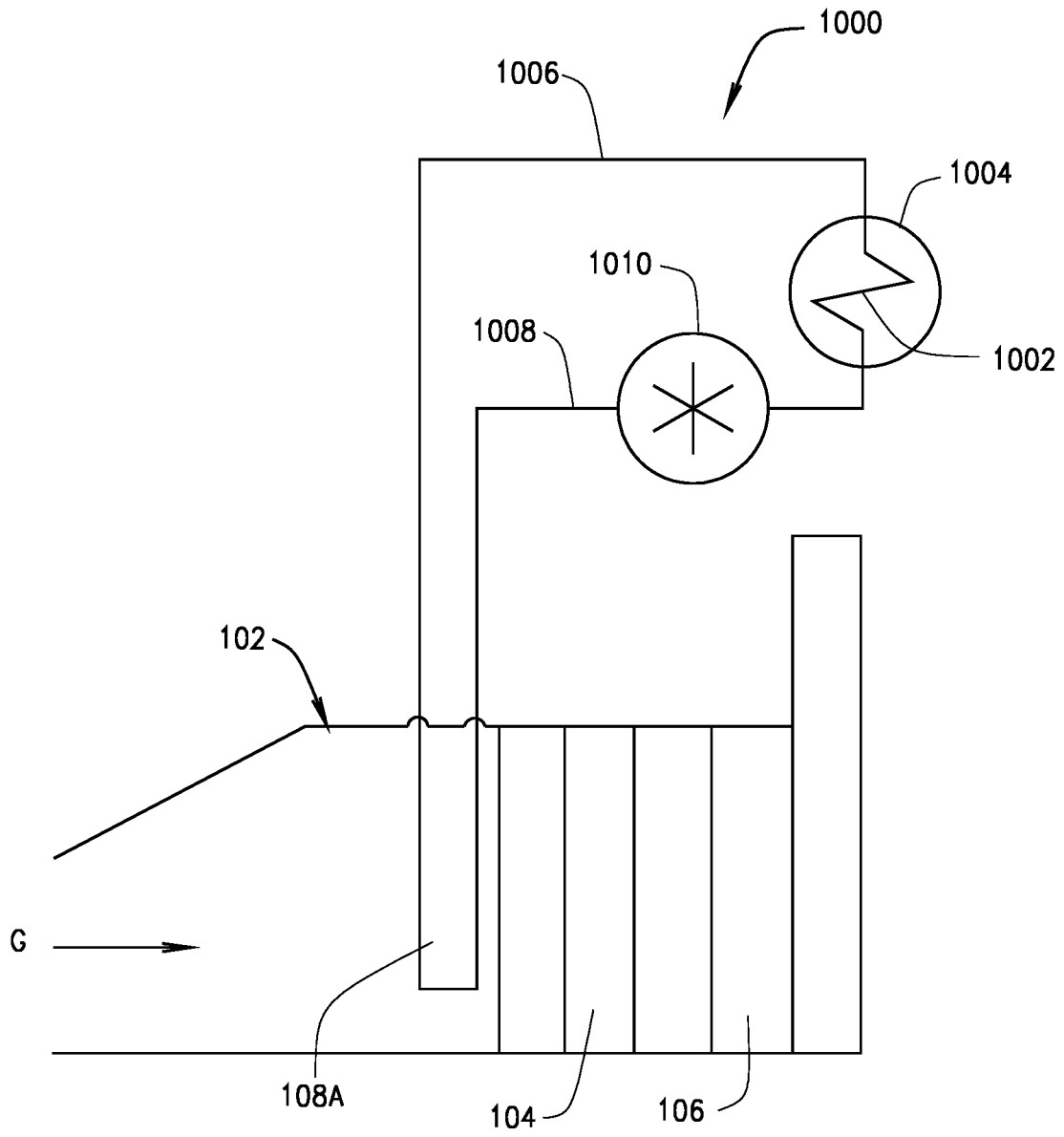
FIG. 10 is a schematic view of an exhaust gas treatment system similar to that of FIG. 1, with a control coil positioned upstream of the catalytic exhaust treatment device and connected in a cooling loop with a Thermal Energy Storage System.

FIG. 10 is a representation of a further embodiment of the system 1000 for treating turbine exhaust gas of this disclosure. The embodiment of FIG. 10 also comprises the exhaust gas discharge structure 102 of FIG. 1. As in the embodiment of FIG. 1, the exhaust gas discharge structure 102 is adapted and configured to receive exhaust gas from a source, such as a gas turbine, and pass the exhaust gas through the exhaust gas discharge structure 102.

As in the embodiment of FIG. 1, the exhaust gas passing through the exhaust gas discharge structure 102 of FIG. 10 passes through a catalytic exhaust gas treatment device 104. The system 1000 of FIG. 10 also comprises a second catalytic exhaust gas treatment device 106. The system 1000 of FIG. 10 further comprises a first heat exchanger 108A positioned at least partially within the exhaust gas discharge structure 102 and upstream of the catalytic exhaust gas treatment device 104. In the same manner as the embodiment of FIG. 1, the first heat exchanger 108A is adapted and configured to remove heat from exhaust gas passing through the exhaust gas discharge structure 102 by transferring heat to a working fluid passing through and within the first heat exchanger 108A. The working fluid can be carbon dioxide, or any other fluid employed in heat exchangers. The working fluid passes through a cooling loop to continuously provide cooling to the exhaust gas during operation of the system 1000. As in the earlier described embodiments, the exhaust gas can be cooled for a purpose other than improving the treatment of the exhaust gas. For example, the exhaust gas can be cooled to maintain the exhaust gas within a specified temperature range irrespective of a temperature range for treating the exhaust gas.

Cooled working fluid passing through the first heat exchanger 108A leaves the first heat exchanger 108A with additional heat. The working fluid leaving the first heat exchanger enters a second heat exchanger 1002 positioned downstream of the first heat exchanger 108A. The second heat exchanger 1002 is adapted and configured to remove heat from the working fluid gained at the first heat exchanger 108A. In the embodiment represented in FIG. 10, the second heat exchanger 1002 is a heat exchanger inside a thermal energy storage system (TESS) or mechanism 1004. The thermal energy storage system 1004 can be a sand bed heat storage media type system or other type of system. The thermal energy storage system 1004 is adapted and configured to remove heat from the working fluid gained at the first heat exchanger 108A and store the heat removed in the heat storage media. This stored heat may be recovered and made use of such as producing additional steam or heating of water within the cycle or other process needs that make use of heat/energy, during times when increased power or plant flexibility is needed. The second heat exchanger 1002 of the thermal energy storage system 1004 is part of a cooling loop positioned outside the exhaust gas discharge structure 102 and outside the exhaust gas passing through the exhaust gas discharge structure.

As represented in FIG. 10, the cooling loop is comprised of conduits 1006, 1008 or other types of fluid conducting means that extend from the first heat exchanger 108A to the second heat exchanger 1002 of the thermal energy storage system 1004, and then return from the second heat exchanger 1002 to the first heat exchanger 108A. A pump 1010 is positioned downstream of the thermal energy storage system 1004. The pump 1010 is in fluid communication with the thermal energy storage system 1004 and is adapted and configured to cycle the working fluid through the cooling loop defined by the first heat exchanger 108A, the conduits 1006, 1008, and the thermal energy storage system 1004. The pump 1010 is also a part of the cooling loop.

The first heat exchanger 108A is positioned at the entrance to the exhaust gas discharge structure 102 to support fast, unrestricted startup of a gas turbine that supplies a flow of hot exhaust gas to the exhaust gas discharge structure 102. Because the first heat exchanger 108A can be controlled to reduce the heat or limit the heat of the exhaust gas from the gas turbine that enters the exhaust gas discharge structure 102, the exhaust gas discharge structure 102 is not required to be constructed with limits based on the heat of the turbine exhaust gas entering the exhaust gas discharge structure 102. Additionally, because the first heat exchanger 108A can be controlled to reduce or limit the heat of the exhaust gas from the gas turbine that enters the exhaust gas discharge structure 102, the gas turbine can quickly be brought to full power load with the hot exhaust gas from the turbine entering the exhaust gas discharge structure 102 being controllably cooled by the first heat exchanger 108A. The operation of the pump 1010 can be adjusted to adjust the flow of cooling fluid through the first heat exchanger 108A and thereby adjust the heat of the exhaust gas passing through the first heat exchanger 108A and entering the exhaust gas discharge structure 102.

Figure 11:
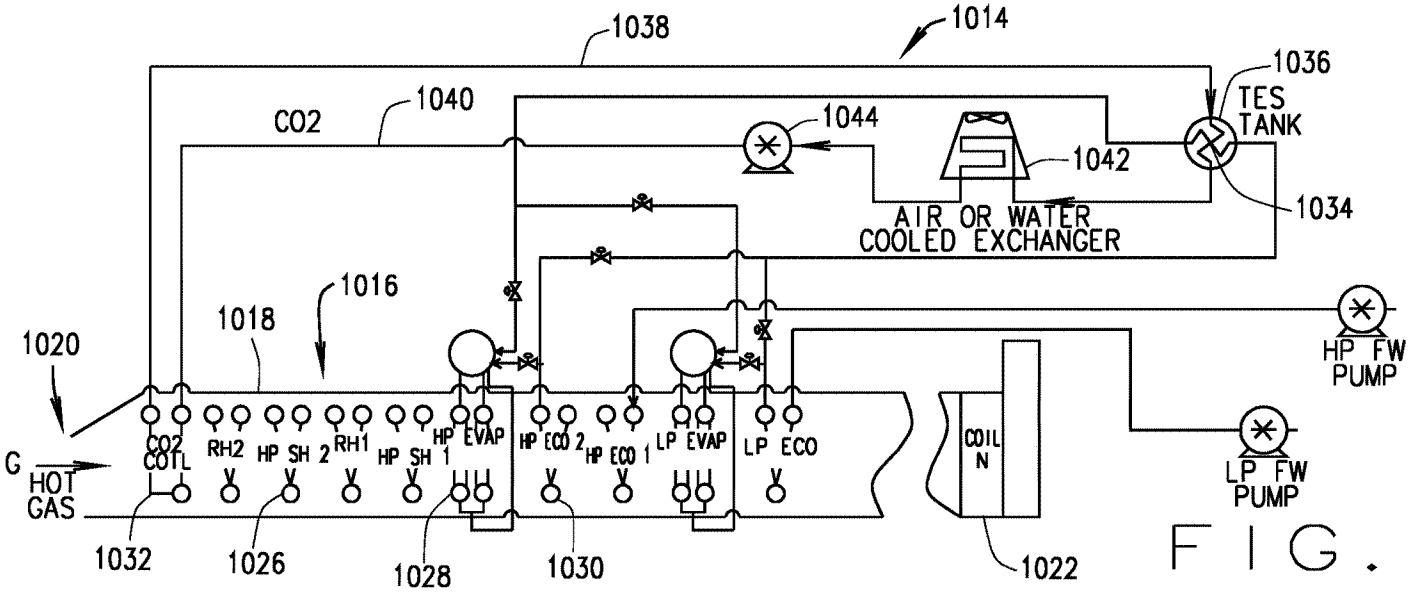
FIG. 11 is a schematic view of an alternative embodiment of the cooling system of FIG. 10 with a control coil positioned upstream of a Heat Recovery Steam Generator (HRSG) and connected in a cooling loop with a Thermal Energy Storage System (TESS)

FIG. 11 is a representation of a further embodiment of the system 1014 for treating turbine exhaust gas. FIG. 11 represents a system 1014 that is similar to the system 1000 of FIG. 10, except that in FIG. 11 the exhaust gas discharge structure 102 of FIG. 10 is replaced with a heat recovery steam generator (HRSG) 1016. The heat recovery steam generator 1016 is for example of a type described in the U.S. Pat. No. 6,508,206, ("206 patent" or U.S. Pat. No. 10,108,086, ('086 patent) both of which are incorporated by reference herein in their entireties. The heat recovery steam generator 1016 is adapted and configured to receive hot exhaust gas G from a source, such as a gas turbine, and pass the exhaust gas G through the heat recovery steam generator 1016. The heat recovery steam generator 1016 represented in FIG. 11, as well as the heat recovery steam generators represented in FIGS. 12-15, comprise common components typically employed in heat recovery steam generators such as those described in the earlier referenced patents. Typical components of heat recovery steam generator 1016 of FIG. 11 include a housing 1018 having a duct therethrough, an upstream end 1020 and an opposite downstream end 1022. The upstream end 1020 is connected in communication with a gas turbine such that the exhaust gases G discharged by the gas turbine flow from left to right as represented in FIG. 11 into the upstream end 1020 of the heat recovery steam generator housing 1018 and through the duct of the heat recovery steam generator 1016. The downstream end 1022 or discharge end of the heat recovery steam generator 1016 is connected in fluid communication to a flu or stack 1024 that directs the exhaust gases to the atmosphere. In the exemplary FIG. 11 system, the heat recovery steam generator 1016 include a superheater 1026, an evaporator 1028, an economizer 1030 and a feed water heater such as depicted as 20 in the '206 patent that are arranged basically in that order from left to right from the upstream end 1020 to the downstream end 1022 of the housing 1018. Feed water can flow from the feedwater heater into the economizer 1030, thence into evaporator 1028 which converts it into saturated steam. The superheater 1026 shown as high pressure superheater HP SH2 converts the saturated steam into superheated steam which flows on to the steam turbine to power the steam turbine. The heat recovery steam generator 1016 generates steam from the heat of the exhaust gas and supplies the steam to the steam turbine to drive the steam turbine in a conventional manner. It should be understood that the heat recovery steam generator 1016 represented in FIG. 11 also generally depicts other components of HRSGs known in the art, such as another high pressure superheater HP SH1, reheaters RH1 and RH2, a low pressure economizer LP ECO, a low pressure evaporator LP EVAP with 1028 designating the high pressure evaporator HP EVAP. FIG. 11 is only one example of a heat recovery steam generator with which the heat storage concept of this disclosure can be employed, and the heat storage concept of this disclosure is not limited to use with a heat recovery steam generator such as that represented in FIG. 11. For example, the heat storage concept of this disclosure can be employed in heat recovery steam generators such as those represented in FIGS. 12-15. The system of FIG. 11 also comprises a first heat exchanger 1032 connected in a cooling loop with a second heat exchanger 1034 of a thermal energy storage system 1036. The first heat exchanger 1032 is positioned at least partially within the entrance of the heat recovery steam generator 1016. As in the previous embodiments, the first heat exchanger 1032 is adapted and configured to remove heat from exhaust gas G passing through the heat recovery steam generator 1016 by transferring heat to a working fluid passing through the first heat exchanger 1032. The working fluid can be carbon dioxide, or any other fluid. The working fluid passes through the cooling loop to continuously provide cooling to the exhaust gas during the operation of the system 1014. As in the earlier described embodiments, the exhaust gas can be cooled for a variety of purposes. In particular, the exhaust gas can be cooled to maintain the exhaust gas within a specified temperature range that is below a temperature that could cause damage to any of the components of the heat recovery steam generator 1016. As in the embodiment of FIG. 10, the cooled working fluid passes through the first heat exchanger 1032 and leaves the first heat exchanger with additional heat. The working fluid leaves the first heat exchanger 1032 and is directed through a first conduit 1038 to the second heat exchanger 1034 positioned downstream of the first heat exchanger 1032. The second heat exchanger 1034 is adapted and configured to remove heat from the working fluid gained at the first heat exchanger 1032. As in the embodiment of FIG. 10, the second heat exchanger 1034 is a heat exchanger inside a thermal energy storage system 1036. The thermal energy storage system 1036 can be a sand bed heat storage media type system, or other type of system. The thermal energy storage system 1036 is adapted and configured to remove heat from the working fluid gained at the first heat exchanger 1032 and store the heat removed in the heat storage media. This stored heat may be recovered and made use of such as producing additional steam or heating of water within the cycle or for other process needs that may make use of stored energy/heat, during times when increased power or plant flexibility is needed. The working fluid leaves the second heat exchanger 1034 and is directed through a second conduit 1040 back to the first heat exchanger 1032 to complete the cooling loop. As represented in FIG. 11, an air or water cooled heat exchanger 1042 can be positioned in the cooling loop downstream of the second heat exchanger 1034 and upstream of the first heat exchanger 1032. The air or water cooled heat exchanger 1042 is operable to further cool the working fluid before the working fluid is delivered to the first heat exchanger 1032. There is also a pump 1044 positioned in the cooling loop of FIG. 11. The pump 1044 cycles the cooling fluid through the cooling loop between the first heat exchanger 1032 and the second heat exchanger 1034 of the thermal energy storage system 1036.

A further feature of this system represented in FIG. 11, is that as the thermal storage medium of the thermal energy storage system 1036 heats up, the working fluid at the outlet of the second heat exchanger 1034 of the thermal energy storage system 1036 could be directed to heat exchangers of the heat recovery steam generator 1016, for example to a low pressure evaporator or a high pressure evaporator as represented in FIG. 11 for preheating of these components of the heat recovery steam generator 1016.

Figure 12:
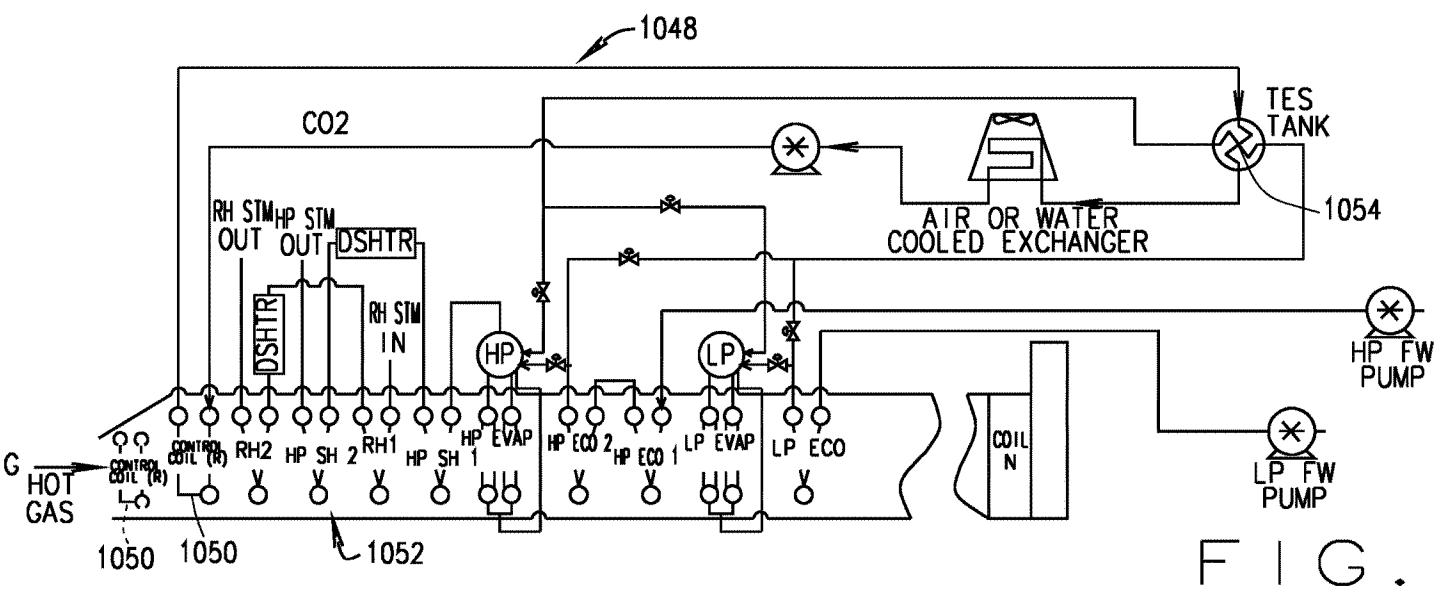
FIG. 12 is a schematic view of a further embodiment of the cooling system of FIG. 11 with a control coil positioned upstream of a Heat Recovery Steam Generator (HRSG) and connected in a cooling loop with a Thermal Energy Storage System (TESS)

A further feature of the system represented in FIG. 11 is that the second heat exchanger 1034 of the thermal energy storage system 1036 functions as a charge heat exchanger 1034. The charge heat exchanger 1034 charges or adds heat to the heat storage media of the thermal energy storage system 1036. There is also a discharge heat exchanger 1046 in the heat storage media of the thermal energy storage system 1036. The heat built up in the heat storage media of the thermal energy storage system 1036 is discharged to the discharge heat exchanger 1046. Working fluid from the heat recovery steam generator 1016, for example from an economizer flows from the heat recovery steam generator 1016 to the thermal energy storage system 1036 and through the discharge heat exchanger 1046. As the working fluid flows through the discharge heat exchanger 1046 the working fluid gains heat discharged from the heat storage media of the thermal energy storage system 1036. The heated working fluid then flows from the discharge heat exchanger 1046 of the thermal energy storage system 1036 and is directed to the heat recovery steam generator 1016, for example to a low pressure evaporator or a high pressure evaporator of the heat recovery steam generator 1016 as represented in FIG. 11 for preheating these components of the heat recovery steam generator FIG. 12 is a representation of a still further embodiment of the system 1048 for treating turbine exhaust gas. The system of FIG. 12 is substantially the same as the system of FIG. 11, with FIG. 12 representing that the first heat exchanger 1050 represented in solid lines can be positioned at a first position at the entrance to the heat recovery steam generator 1052, or the first heat exchanger 1050 represented in dashed lines can be positioned at a second position at the entrance of the heat recovery steam generator 1052. The ability to optionally position the first heat exchanger 1050 at the first position in the heat recovery steam generator 1052 or at the second position in the heat recovery steam generator 1052 provides a further means of adjusting the heat of the gas turbine exhaust entering the heat recovery steam generator 1052. As represented in FIG. 12, there is a larger vertical space in the first position of the first heat exchanger 1050 represented by solid lines that allows for a vertically larger first heat exchanger 1050 at the first position than the first heat exchanger 1050 represented by dashed lines at the second position. The first heat exchanger 1050, whether at the first position or the second position in the heat recovery steam generator 1052, is connected in the cooling loop with a second heat exchanger 1054 of a thermal energy storage system 1048.

Figure 13:
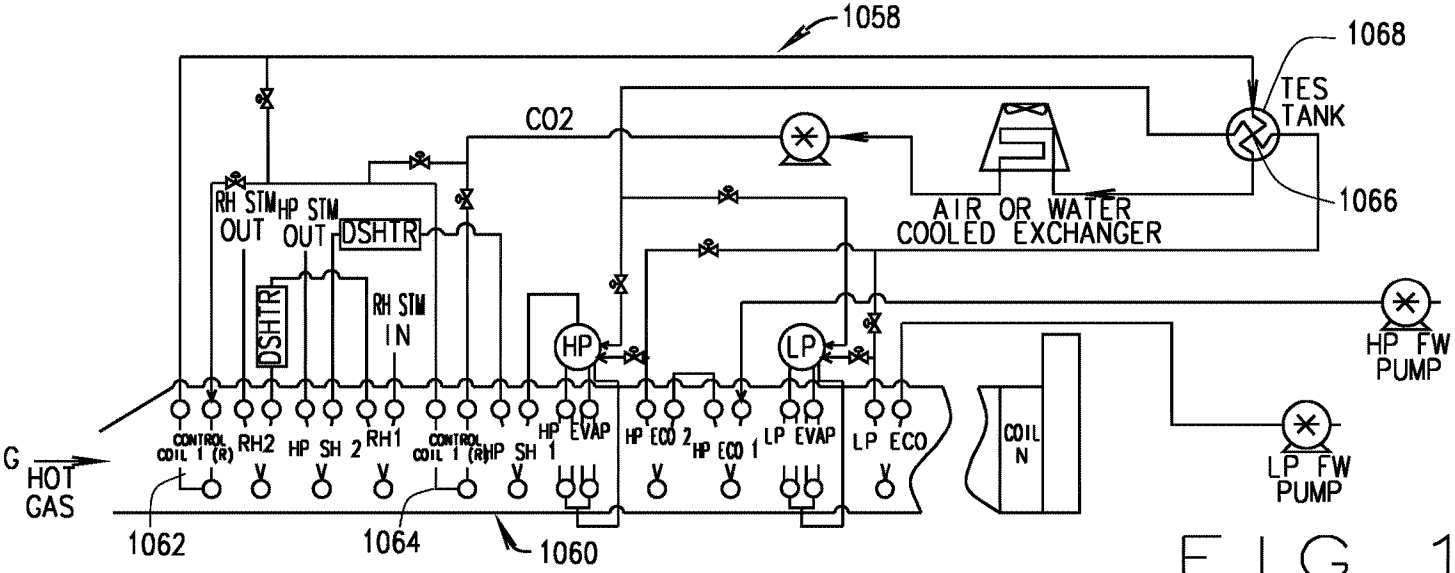
FIG. 13 is a schematic view of a further embodiment of the cooling system of FIG. 11 with a control coil positioned upstream of a Heat Recovery Steam Generator (HRSG) and connected in a cooling loop with a Thermal Energy Storage System (TESS)

FIG. 13 is a representation of a further embodiment of the system 1058 for treating exhaust gas that employs a pair of cooling coils at different positions along the flow path in the heat recovery steam generator 1060. In FIG. 13 a first heat exchanger 1062 is positioned at the entrance of the heat recovery steam generator 1060 and a second heat exchanger 1064 is positioned further downstream in the heat recovery steam generator 1060 between reheater RH1 and high pressure superheater HP SH1. Both the first heat exchanger 1062 and the second heat exchanger 1064 are connected in the cooling loop with a third heat exchanger 1066 of a thermal energy storage system 1068.

Figure 14:
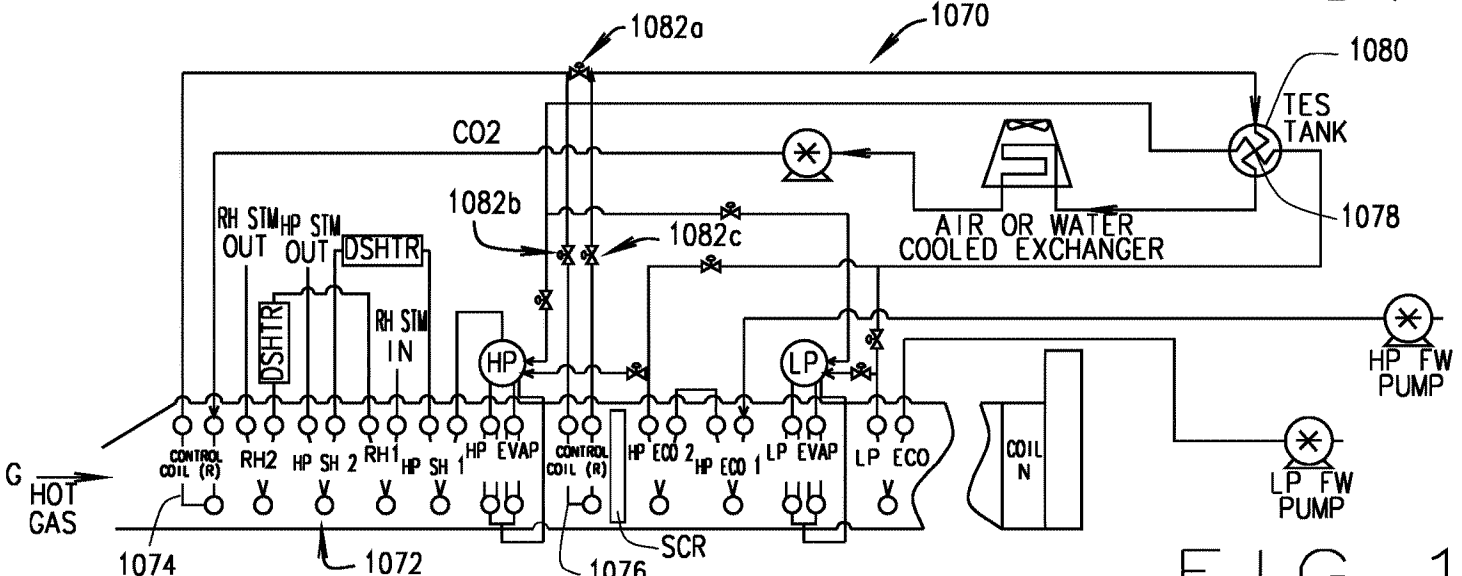
FIG. 14 is a schematic view of a further embodiment of the cooling system of FIG. 11 with a control coil positioned upstream of a Heat Recovery Steam Generator (HRSG) and connected in a cooling loop with a Thermal Energy Storage System (TESS)

FIG. 14 is a representation of a system 1070 for treating turbine exhaust gas similar to that of FIG. 13. The system of FIG. 14 also comprises a heat recovery steam generator 1072 containing a first heat exchanger 1074 and a second heat exchanger 1076 positioned at spaced positions along the exhaust gas flow path through the heat recovery steam generator 1072. FIG. 14 also illustrates a selective catalytic reactor (SCR) catalyst with the second exchanger 1076 positioned immediately upstream of the SCR and immediately downstream of the high pressure evaporator (HP EVAP). The first heat exchanger 1074 and the second heat exchanger 1076 are also connected in the cooling loop with the third heat exchanger 1078 of the thermal energy storage system 1080. The system represented in FIG. 14 also differs from the system represented in FIG. 13 in that a series of valves 1082*a*, 1082*b*, 1082*c* are provided in the cooling loop. The series of valves 1082*a*, 1082*b*, 1082*c* are selectively operable to include the second heat exchanger 1076 in the cooling loop or to exclude the second heat exchanger 1076 from the cooling loop. For example, the valve 1082*a* can be closed and the valves 1082*b* and 1082*c* can be opened to connect the second heat exchanger 1076 in series communication with the first heat exchanger 1074 and the third heat exchanger 1078 in the cooling loop.

In this configuration of the cooling loop, the fluid passing through the first heat exchanger 1074 receives heat from the flow of turbine exhaust gas G entering the heat recovery steam generator 1072 and passing through the first heat exchanger 1074. The heated fluid then passes through the second heat exchanger 1076 and discharges heat to the flow of exhaust gas that has been cooled by flowing through components of the heat recovery steam generator 1072 upstream of the second heat exchanger 1076. The flow of exhaust gas reheated by the second heat exchanger 1076 then passes through the catalytic converter (SCR). Reheating the flow of exhaust gas at the second heat exchanger 1076 prior to the exhaust gas passing through the catalytic converter (SCR) allows for faster heat up of the catalytic converter (SCR). Thus, in the cooling loop of FIG. 14, high temperature turbine exhaust gas can be received at the entrance to the heat recovery steam generator 1072 which allows for faster gas turbine start up. The high temperature exhaust gas received heats up the working fluid in the first heat exchanger 1074. The heated working fluid is then delivered from the first heat exchanger 1074 to the second heat exchanger 1076 at the face of or upstream of the catalytic converter (SCR). The heated working fluid passing through the second heat exchanger 1076 reheats the flow of exhaust gas that passes through the second heat exchanger 1076 and then passes through the catalytic converter (SCR). The reheated exhaust gas passing through the catalytic converter (SCR) brings the temperature of the catalytic converter (SCR) up faster and begins emission control into operation quicker than would be possible without the cooling loop.

Figure 15:
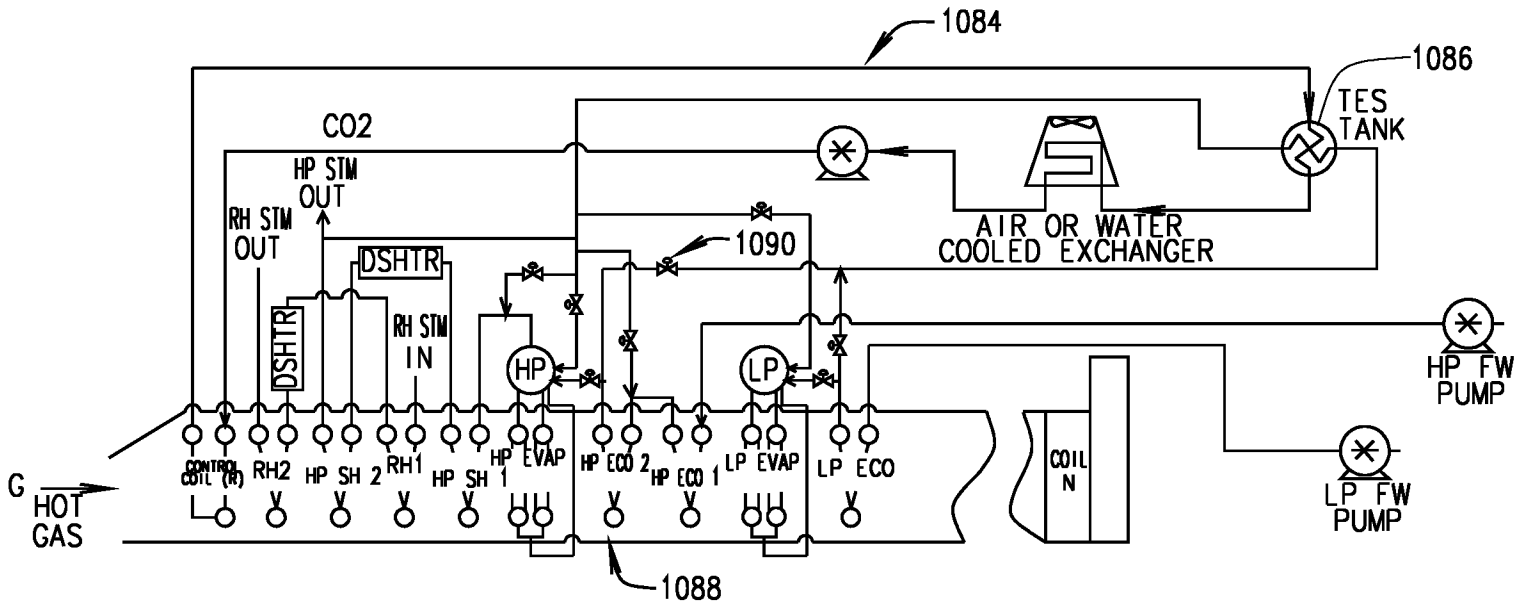
FIG. 15 is a schematic view of a further embodiment of the cooling system of FIG. 11 with a control coil positioned upstream of a Heat Recovery Steam Generator (HRSG) and connected in a cooling loop with a Thermal Energy Storage System (TESS).

Alternatively, the valve 1082*a* can be opened and the valves 1082*b* and 1082*c* can be closed to communicate the first heat exchanger 1074 directly with the third heat exchanger 1078 and exclude the second heat exchanger 1076 from the cooling loop. The exchanger coil 1074 can be in flow connection with the SCR so that the hot fluid from exchanger 1074 can quickly flow to the SCR to quickly move heat to the SCR to warm the catalyst quickly for emission reduction. The second heat exchanger coil 1076 is positioned in the heat recovery steam generator 1072 immediately upstream of the selective catalytic reducer SCR. At this position the second heat exchanger 1076 is operable to cool exhaust gas passing through the heat reduction steam generator 1072 prior to the exhaust gas passing through the SCR. This enables the second heat exchanger 1076 to control and reduce the exhaust gas temperature to be within the range of treatment of the SCR, and optimize the catalytic reactions of the SCR in treating the exhaust gas. FIG. 15 is a representation of a still further embodiment of the system 1084 for treating turbine exhaust gas that is similar to those of the previously described systems. The system of FIG. 15 represents that the cooling loop that includes the thermal energy storage system 1086 can be selectively communicated with various components of the heat recovery steam generator 1088. The cooling loop includes a series of valve assemblies 1090 that can be selectively operated to connect the thermal energy storage system 1086 to the various components of the heat recovery steam generator 1088, or disconnect the thermal energy storage system 1086 from the various components of the heat recovery steam generator 1088 as represented in FIG. 15.

Each of the embodiments of the system for treating turbine exhaust gas G and controlling a temperature of turbine exhaust gas entering a heat recovery steam generator described above with reference to FIGS. 11-15 support fast, unrestricted startup of a gas turbine communicating with a heat recovery steam generator without imposing limits or at least reducing any limitations on how fast the gas turbine can be operated from no load to full load. The arrangements also allow for increased range of operation for the gas turbine and combined cycle by allowing lower operating ranges to be sustained. The systems for treating turbine exhaust gas G represented in the embodiments of FIGS. 11-15 each provide at least an inlet or first heat exchanger control coil at the entrance of a heat recovery steam generator. The first heat exchanger is part of a cooling loop that is operable to cool and adjust the heat of turbine exhaust gas G entering the heat recovery steam generator which enables controlling the heating up of the heat recovery steam generator by controlling a flow of cooling fluid through the inlet or first heat exchanger control coil. The FIGS. 11-15 embodiments allow the cooling of the inlet gas to the HRSG without the use of desuperheaters and thus provide for consumption of energy.

Further advantages of the systems described herein include the following. The systems described herein can eliminate the need for, or reduce the complexity of, flow conditioning devices in the turbine exhaust gas stream, which are often required to ensure good hot turbine exhaust gas flow distribution at the face of the catalyst systems. These flow distribution devices are subject to high turbine exhaust gas temperature and very turbulent turbine exhaust gas flows resulting in a prohibitive cost to supply/install due to the requirements of operation. The systems described herein can eliminate or reduce these flow distribution devices as a result of the turbine exhaust gas being more controllably cooled and/or as a result of the elimination of any dilution air. In other words, flow distribution devices are not needed to adequately mix dilution air with the turbine exhaust gas as the described systems do not use dilution air. Further or alternatively, the heat exchangers positioned within the turbine exhaust gas discharge structure can adequately distribute flow of the turbine exhaust gas.

It should also be understood that the systems described transfer heat from the turbine exhaust gas to a plurality of locations/applications where said energy can be used for other heating applications and/or power generation. The heated working fluid can heat other process fluids through a heat exchanger. The heated working fluid can drive a mechanical device (e.g., a pump). Further, the heated working fluid can be expanded to drive a turbine which in turn drives an electrical generator.

As various changes could be made in the above constructions and methods without departing from the broad scope of the disclosure, it is intended that all matter contained in the above description or shown in the accompanying drawings shall be interpreted as illustrative and not in a limiting sense.

The invention claimed is:

1. A system for treating turbine exhaust gas comprising:

an exhaust gas discharge structure adapted and configured to receive exhaust gas from a turbine and pass the exhaust gas through the exhaust gas discharge structure; a catalytic exhaust gas treatment device positioned at least partially within the exhaust gas discharge structure, the catalytic exhaust gas treatment device adapted and configured to treat at least one component of the turbine exhaust gas through a catalytic reaction between a catalyst contained within the catalytic exhaust gas treatment device and the at least one component of the exhaust gas;

a first heat exchanger positioned at least partially within the exhaust gas discharge structure and upstream of the catalytic exhaust gas treatment device, the first heat exchanger adapted and configured to remove heat from an exhaust gas passing through the exhaust gas discharge structure by transferring heat to a working fluid passing through the first heat exchanger, the working fluid passing through a cooling loop to continuously provide cooling to the exhaust gas during operation of the system for treating exhaust gas, the first heat exchanger being a part of the cooling loop;

a second heat exchanger positioned downstream of the first heat exchanger in the cooling loop and in fluid communication with the first heat exchanger, the second heat exchanger being a heat exchanger of a thermal energy storage system that is adapted and configured to remove heat from the working fluid gained at the first heat exchanger and store the heat removed in a heat storage media, the second heat exchanger being a part of the cooling loop positioned outside the exhaust gas discharge structure and outside the exhaust gas passing through the exhaust gas discharge structure; and a pump positioned downstream of the thermal energy storage system in the cooling loop and being in fluid communication with the thermal energy storage system, the pump adapted and configured to cycle the working fluid through the cooling loop, the pump being a part of the cooling loop.

2. The system of claim 1, further comprising:

the thermal energy storage system being an energy storage vessel containing a heat storage medium.

3. The system of claim 2, further comprising: the heat storage medium is sand.

4. The system of claim 3, further comprising:

the energy storage vessel contains a charge heat exchanger and a discharge heat exchanger; and the charge heat exchanger is the second heat exchanger.

5. The system of claim 4, further comprising:

the charge heat exchanger and the discharge heat exchanger being in heat transfer communication with the heat storage medium contained in the energy storage vessel.

6. A system for treating turbine exhaust gas comprising:

an exhaust gas discharge structure adapted and configured to receive exhaust gas from a turbine and pass the exhaust gas through the exhaust gas discharge structure; an exhaust gas heat recovery device positioned within the exhaust gas discharge structure, the exhaust gas heat recovery device adapted and configured to recover heat from exhaust gas passing through the exhaust gas discharge structure through heat transfer between the exhaust gas and a first working fluid cycling through the exhaust gas heat recovery device;

a first heat exchanger positioned at least partially within the exhaust gas discharge structure and upstream of the exhaust gas heat recovery device, the first heat exchanger adapted and configured to remove heat from an exhaust gas prior to the exhaust gas passing through the exhaust gas discharge structure by transferring heat to a second working fluid passing through the first heat exchanger, the second working fluid passing through a cooling loop to continuously provide cooling to the exhaust gas and control heat of the exhaust gas during operation of the system for treating turbine exhaust gas, the first heat exchanger being a part of the cooling loop;

a second heat exchanger positioned downstream of the first heat exchanger in the cooling loop and being in fluid communication with the first heat exchanger, the second heat exchanger being a heat exchanger of a thermal energy storage mechanism that is adapted and configured to remove heat from the second working fluid gained at the first heat exchanger and store the removed heat in a heat storage media, the second heat exchanger being a part of the cooling loop positioned outside the exhaust gas discharge structure and outside the exhaust gas passing through the exhaust gas discharge structure; and a pump positioned downstream of the second heat exchanger of the thermal energy storage mechanism and being in fluid communication with the second heat exchanger of the thermal energy storage mechanism, the pump adapted and configured to cycle the second working fluid through the cooling loop, the pump being a part of the cooling loop.

7. The system of claim 6, further comprising:

the thermal energy storage mechanism comprises an energy storage vessel containing a heat storage medium.

8. The system of claim 7, further comprising: the heat storage medium is sand.

9. The system of claim 8, further comprising: the energy storage vessel contains a charge heat exchanger and a discharge heat exchanger; and the charge heat exchanger is the second heat exchanger in the cooling loop with the first heat exchanger.

10. The system of claim 9, further comprising:

the charge heat exchanger and the discharge heat exchanger being in heat transfer communication with the sand heat storage medium.

11. The system of claim 10, further comprising: the discharge heat exchanger being in fluid communication with the exhaust gas heat recovery device downstream of the first heat exchanger.

12. The system of claim 6, further comprising:

a third heat exchanger positioned at least partially within the exhaust gas discharge structure and downstream of the exhaust gas heat recovery device with the exhaust gas heat recovery device positioned between the first heat exchanger and the third heat exchanger, the third heat exchanger adapted and configured to remove heat from an exhaust gas passing through the exhaust gas discharge structure by transferring heat to the second working fluid passing through the third heat exchanger, the second working fluid passing through a cooling loop to continuously provide cooling to the exhaust gas during operation of the system for treating turbine exhaust gas, the third heat exchanger being a part of the cooling loop; and the second heat exchanger of the thermal energy storage mechanism being positioned downstream of the first heat exchanger and the third heat exchanger in the cooling loop and being in fluid communication with the first heat exchanger and the third heat exchanger, the second heat exchanger of the thermal energy storage mechanism being adapted and configured to remove heat from the second working fluid gained at the first heat exchanger and at the third heat exchanger and store the removed heat in the heat storage media.

13. The system of claim 6, further comprising:

the exhaust gas discharge structure is a heat recovery steam generator.

14. A system for treating turbine exhaust gas comprising:

a heat recovery steam generator adapted and configured to receive exhaust gas from a turbine and pass the exhaust gas through the heat recovery steam generator;

an exhaust gas heat recovery device positioned within the heat recovery steam generator, the exhaust gas heat recovery device adapted and configured to recover heat from exhaust gas passing through the heat recovery steam generator through heat transfer between the exhaust gas and a first working fluid cycling through the exhaust gas heat recovery device;

a first heat exchanger positioned at least partially within the heat recovery steam generator and upstream of the exhaust gas heat recovery device, the first heat exchanger adapted and configured to remove heat from an exhaust gas prior to the exhaust gas passing through the heat recovery steam generator by transferring heat to a second working fluid passing through the first heat exchanger, the second working fluid passing through a cooling loop to continuously provide cooling to the exhaust gas and control heat of the exhaust gas during operation of the system for treating turbine exhaust gas, the first heat exchanger being a part of the cooling loop;

a second heat exchanger positioned downstream of the first heat exchanger in the cooling loop and being in fluid communication with the first heat exchanger, the second heat exchanger being a heat exchanger of a thermal energy storage mechanism that is adapted and configured to remove heat from the second working fluid gained at the first heat exchanger and store the removed heat in a heat storage media, the second heat exchanger being a part of the cooling loop positioned outside the heat recovery steam generator and outside the exhaust gas passing through the heat recovery steam generator; and a pump positioned downstream of the second heat exchanger of the thermal energy storage mechanism and being in fluid communication with the second heat exchanger of the thermal energy storage mechanism, the pump adapted and configured to cycle the second working fluid through the cooling loop, the pump being a part of the cooling loop.

15. The system of claim 14, further comprising:

the thermal energy storage mechanism comprises an energy storage vessel containing a heat storage medium.

16. The system of claim 15, further comprising: the heat storage medium is sand.

17. The system of claim 16, further comprising:

the energy storage vessel contains a charge heat exchanger and a discharge heat exchanger; and the charge heat exchanger is the second heat exchanger in the cooling loop with the first heat exchanger.

18. The system of claim 17, further comprising:

the charge heat exchanger and the discharge heat exchanger in the energy storage vessel are in heat transfer communication with the sand heat storage medium.

19. The system of claim 18, further comprising:

the discharge heat exchanger in the energy storage vessel being in fluid communication with the exhaust gas heat recovery device in the heat recovery steam generator downstream of the first heat exchanger.

20. The system of claim 14, further comprising:

a third heat exchanger positioned within the heat recovery steam generator and downstream of the exhaust gas heat recovery device, the exhaust gas heat recovery device being positioned between the first heat exchanger and the third heat exchanger, the third heat exchanger adapted and configured to remove heat from an exhaust gas passing through the heat recovery steam generator by transferring heat to the second working fluid passing through the third heat exchanger, the second working fluid passing through the cooling loop to continuously provide cooling to the exhaust gas during operation of the system for treating turbine exhaust gas, the third heat exchanger being a part of the cooling loop; and the second heat exchanger of the thermal energy storage mechanism being positioned downstream of the first heat exchanger and the third heat exchanger in the cooling loop and being in fluid communication with the first heat exchanger and the third heat exchanger, the second heat exchanger of the thermal energy storage mechanism being adapted and configured to remove heat from the second working fluid gained at the first heat exchanger and at the third heat exchanger and store the removed heat in the heat storage medium.

21. The system of claim 14, further comprising:

the heat recovery steam generator comprising a superheater, an evaporator and a feedwater heater.

22. A method for treating gas turbine exhaust gas flowing through an exhaust gas discharge structure comprising:

directing a flow of exhaust gas from a gas turbine through a catalytic exhaust gas treatment device located at least partially within the exhaust gas discharge structure and treating at least one component of the exhaust gas through a catalytic reaction between a catalyst contained within the catalytic exhaust gas treatment device and the at least one component of the exhaust gas;

directing the flow of exhaust gas from the gas turbine through a first heat exchanger located at least partially within the exhaust gas discharge structure and transferring heat from the flow of exhaust gas directed through the first heat exchanger to working fluid passing through the first heat exchanger;

directing the working fluid through a cooling loop to continuously provide cooling to the exhaust gas directed through the first heat exchanger with the first heat exchanger being a part of the cooling loop;

directing the working fluid through the cooling loop downstream of the first heat exchanger to a second heat exchanger in the cooling loop, the second heat exchanger being a heat exchanger of a thermal energy storage system; and removing heat from the working fluid gained at the first heat exchanger and storing the heat removed in a heat storage media of the thermal energy storage system.

23. The method of claim 22, further comprising:

the second heat exchanger of the thermal energy storage system being a part of the cooling loop positioned outside the exhaust gas discharge structure.

24. The method of claim 22, further comprising:

cycling the working fluid through the cooling loop by operation of a pump in the cooling loop, the pump being positioned downstream of the thermal energy storage system in the cooling loop.

25. The method of claim 22, further comprising:

the exhaust gas discharge structure being a heat recovery steam generator, and directing the flow of exhaust gas from the gas turbine through the first heat exchanger located at least partially within the heat recovery steam generator.

26. The method of claim 22, further comprising:

removing heat from the working fluid at the thermal energy storage system by a charge heat exchanger of the thermal energy storage system that charges the heat storage medium with heat removed from the working fluid; and discharging heat from the heat storage medium to a discharge heat exchanger of the thermal energy storage system in heat transfer communication with the heat storage medium.

27. The method of claim 26, further comprising:

communicating the discharge heat exchanger in fluid communication with an exhaust gas heat recovery device in the exhaust gas discharge structure downstream of the first heat exchanger.

* * * * *